US012185894B2

(12) United States Patent
Garnett

(10) Patent No.: US 12,185,894 B2
(45) Date of Patent: Jan. 7, 2025

(54) MAGNETIC HEIGHT ADJUSTMENT ASSEMBLY FOR DISHWASHER RACKS

(71) Applicant: Haier US Appliance Solutions, Inc., Wilmington, DE (US)

(72) Inventor: William Nathan Garnett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 455 days.

(21) Appl. No.: 17/720,810

(22) Filed: Apr. 14, 2022

(65) Prior Publication Data

US 2023/0329520 A1 Oct. 19, 2023

(51) Int. Cl.
*A47L 15/50* (2006.01)

(52) U.S. Cl.
CPC ..... *A47L 15/504* (2013.01)

(58) Field of Classification Search
CPC ..... A47L 15/504
See application file for complete search history.

(56) References Cited

U.S. PATENT DOCUMENTS

| | | | | |
|---|---|---|---|---|
| 7,651,180 | B2 | 1/2010 | Deiss et al. | |
| 7,775,378 | B2 | 8/2010 | Tynes et al. | |
| 8,192,557 | B2 | 6/2012 | Ryu et al. | |
| 8,567,882 | B1 | 10/2013 | Garnett | |
| 9,004,082 | B2 | 4/2015 | Bhajak et al. | |
| 9,895,046 | B1 * | 2/2018 | Wilson | A47L 15/506 |
| 10,433,704 | B2 | 10/2019 | Bhajak et al. | |
| 10,582,828 | B1 * | 3/2020 | Fawaz | A47L 15/507 |
| 2014/0132147 | A1 * | 5/2014 | Tarcy | A47L 15/506 312/410 |
| 2015/0053237 | A1 * | 2/2015 | Lee | A47L 15/4295 312/228.1 |
| 2018/0249885 | A1 * | 9/2018 | Fawaz | A47L 15/23 |
| 2020/0397216 | A1 * | 12/2020 | Fawaz | A47L 15/46 |
| 2023/0309786 | A1 * | 10/2023 | Fawaz | A47L 15/507 211/41.8 |

FOREIGN PATENT DOCUMENTS

| | | | |
|---|---|---|---|
| EP | 3536216 | A1 | 9/2019 |

* cited by examiner

*Primary Examiner* — Benjamin L Osterhout
(74) *Attorney, Agent, or Firm* — Dority & Manning, P.A.

(57) ABSTRACT

A dishwasher appliance includes a metal rack. A housing and a cover on a side of the metal rack define a housing chamber. Within the housing chamber, one or more rotatable cams are present. Each cam includes a magnet within the cam and pivots about a shaft. Each cam may rotate from a passive position to a retaining position as a result of lifting of the metal rack, which attracts the magnet in each cam, pulling the cam into position. The rack is then lowered onto a retaining surface of each cam, the cam supporting the rack in the raised position.

20 Claims, 18 Drawing Sheets

MAGNETIC HEIGHT ADJUSTMENT ASSEMBLY FOR DISHWASHER RACKS

FIELD OF THE INVENTION

The present disclosure relates generally to dishwasher appliances, and more particularly to an apparatus for adjusting the height of rack using magnets to position cams for support in the raised position and to release such cams when moving to the lowered position.

BACKGROUND OF THE INVENTION

In order for the dishwasher racks to accommodate tall items in either the upper or lower rack, the proximity of racks to each other must occasionally be altered. The most common way to accomplish this change in capacity allocation is to provide adjustability in the height of the upper rack. In conventional, low-end dishwashers this typically requires the user to manually remove the upper rack and then reinstall it at a different level. Conventional high-end dishwashers, however, have various mechanisms which allow for height adjustment without removing the rack, typically by operation of a lever to lift the rack and a supporting structure that slides vertically to maintain the rack at the elevated height.

The conventional supporting structures suffer from a variety of drawbacks. First, the supporting structures have a complicated design due in large part to the necessity of attaching the structure to multiple wires of the dishwasher rack to provide adequate support. This complicated design results in higher lead times, higher costs, and a higher incidence of quality assurance issues. The higher cost, in particular, precludes use of the supporting structures on lower-end dishwashers. In addition, attachment of the support structures to the dishwasher rack during assembly creates additional ergonomic issues. Because of variation in both the molded parts and rack wires, issues with secure fitment and maintenance of ergonomic assembly forces are not uncommon. Accordingly, a dishwasher appliance that utilizes a height adjustment mechanism for a dishwasher rack that is simpler and more cost-effective would be beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a dishwasher appliance is provided. The dishwasher appliance includes a metal rack, one or more housings, one or more covers, one or more cams, and a magnet. The metal rack includes a first sidewall and a second sidewall spaced apart in the lateral direction and defining a rack interior and a rack exterior, the first sidewall and the second sidewall each including a plurality of horizontal wires and a plurality of vertical wires, the metal rack moveable between a lowered position, a raised position, and a release position. The one or more housings are situated on the rack exterior and in contact with the first sidewall or the second sidewall. The one or more covers are situated on the rack interior and in contact with the first sidewall or the second sidewall of the rack, wherein each of the one or more covers is connected to one of the one or more housings through the first sidewall or the second sidewall, the cover and the housing together defining a housing chamber. The one or more cams are located within the housing chamber and are rotatable between a passive position and a retaining position. Each cam may include a first end, a second end, and a cam body. The first end of each cam further includes an opening and a shaft extending through the opening, each cam pivotable about the axis of the shaft. The second end of each cam is spaced apart from the first end of each cam and includes a retaining surface. The cam body extends from the first end to the second end and defines a cam chamber. The magnet is within the cam chamber. The magnet exerts an attraction force on one of the plurality of horizontal wires of the metallic rack within the housing chamber such that moving the metallic rack from the lowered position to the raised position pivots the cam from the passive position to the retaining position and wherein the cam is configured to support the one of the plurality of horizontal wires of the metallic rack when the cam is in the retaining position.

In accordance with one exemplary embodiment of the present disclosure, a dishwasher appliance is provided. The dishwasher appliance includes a metal rack, one or more housings, one or more cams, and a magnet. The metal rack includes a first sidewall and a second sidewall spaced apart in the lateral direction and defining a rack interior and a rack exterior, the first sidewall and the second sidewall each including a plurality of horizontal wires and a plurality of vertical wires, the metal rack moveable between a lowered position, a raised position, and a release position. The one or more housings are situated on the rack exterior and in contact with the first sidewall or the second sidewall. The one or more housings define a housing chamber. The one or more cams are located within the housing chamber and are rotatable between a passive position and a retaining position. Each cam may include a first end, a second end, and a cam body. The first end of each cam further includes an opening and a shaft extending through the opening, each cam pivotable about the axis of the shaft. The second end of each cam is spaced apart from the first end of each cam and includes a retaining surface. The cam body extends from the first end to the second end and defines a cam chamber. The magnet is within the cam chamber. The magnet exerts an attraction force on one of the plurality of horizontal wires of the metallic rack within the housing chamber such that moving the metallic rack from the lowered position to the raised position pivots the cam from the passive position to the retaining position and wherein the cam is configured to support the one of the plurality of horizontal wires of the metallic rack when the cam is in the retaining position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
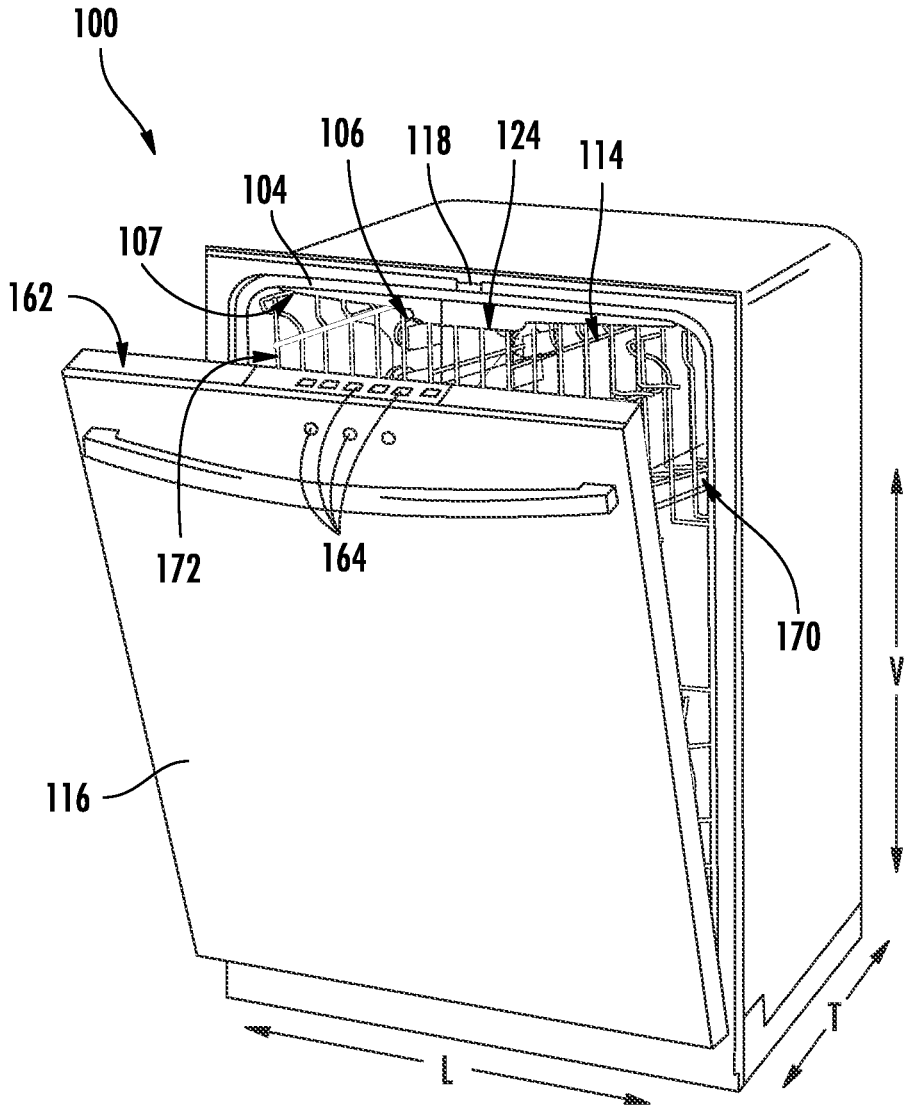
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
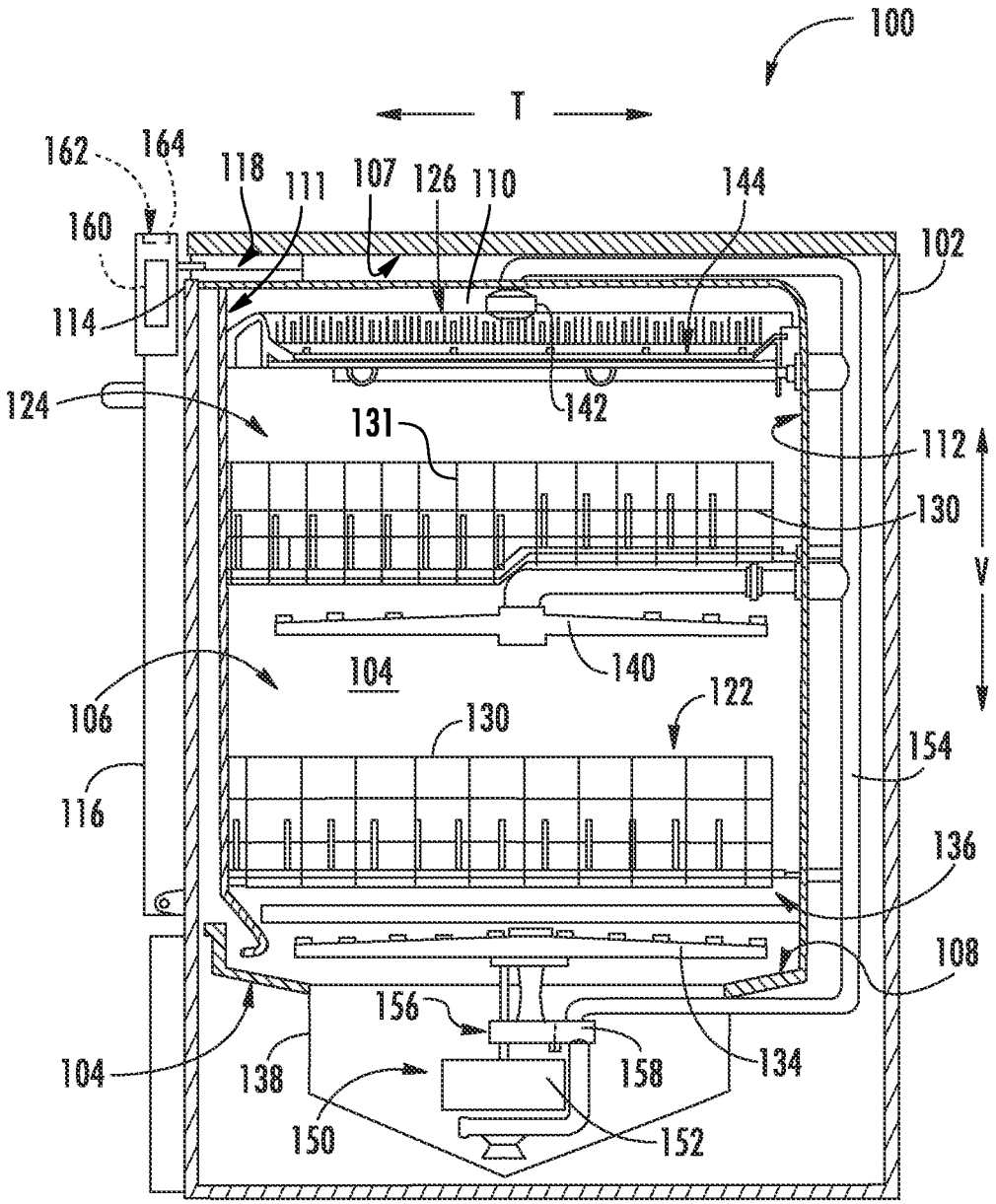
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of interior side walls 110 along a lateral direction L, and the interior side walls 110 extending between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106.

Some or all of the rack assemblies 122, 124, 126 are fabricated into lattice structures including a plurality of horizontal wires or elongated members 130 and a plurality of vertical wires or elongated members 131 (for clarity of illustration, not all wires making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Turning now to FIGS. 3 and 4A-4D, one embodiment of the magnetic height adjustment assembly for dishwasher racks is provided. Although embodiments of the present disclosure are provided herein with reference to rack assembly 124, one of ordinary skill in the art will recognize that the disclosure herein is equally applicable to all of rack assemblies 122, 124, and 126 and that reference to rack assembly 124 is made strictly to aid in illustrating aspects of the present disclosure.

Figure 3:
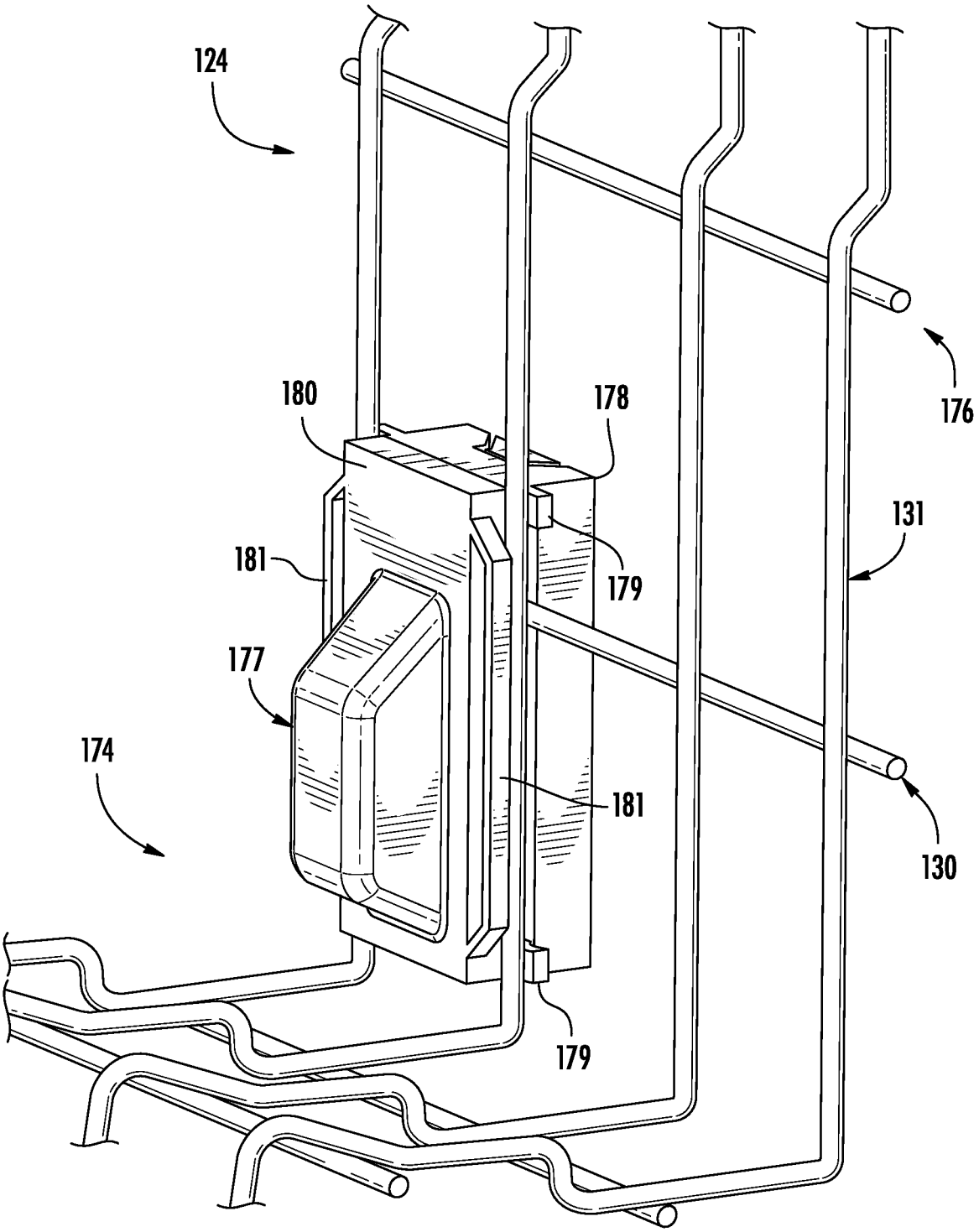
FIG. 3 provides a perspective view of a height adjustment assembly according to an exemplary embodiment of the present disclosure.

Rack assembly 124 may be made from steel or some other metal. The metal rack assemblies, in some circumstances, may be coated with a synthetic vinyl to prevent rusting of the rack and damages to dishes loaded therein. The metal racks, such as rack assembly 124, may include a first sidewall 170 and a second sidewall 172 (FIG. 1). First sidewall 170 and second sidewall 172 may be spaced apart in the lateral direction and together define a rack interior 174 between first sidewall 170 and second sidewall 172, as shown in FIG. 3. First sidewall 170 and second sidewall 172 may also together define a rack exterior 176, which falls outside of first sidewall 170 and second sidewall 172. First sidewall 170 and second sidewall 172, like the entirety of rack assembly 124, is made from a plurality of horizontal wires 130 and a plurality of vertical wires 131. Rack assembly 124 may be moveable between a lowered position, a raised position, and a release position, as further described herein.

Dishwasher appliance 10 may further include one or more height adjustment assemblies 177, as described herein, that works together with rack assembly 124 to lift rack assembly 124 to a raised position, maintain rack assembly 124 at the raised position, lower rack assembly to the lowered position, and maintain rack assembly 124 at the lowered position. Generally, one or more height adjustment assemblies 177 may be mounted to each of first sidewall 170 and second sidewall 172 of rack assembly 124 to support rack assembly 124.

Each height adjustment assembly 177 may include one or more housings 178, an embodiment of which is illustrated in FIG. 3. Each housing 178 may be situated on rack exterior 176 and in contact with first sidewall 170 or second sidewall 172. Where housing 178 meets first sidewall 170 or second sidewall 172, housing 178 may include two housing flanges 179 extending vertically from the top to the bottom of housing 178 and spaced apart from one another transversely. One of the housing flanges 179 may extend from the furthest forward transverse surface of housing 178 (i.e., from the perspective of the front of dishwasher appliance 10). The other of the housing flanges 179 may extend from the further rearward transverse surface of housing 178. In some embodiments, housing flanges 179 may flare at an angle away from first sidewall 170 or second sidewall 172 (e.g., at a 45 degree angle to first sidewall 170 or second sidewall 172). In alternative embodiments, housing flanges 179 may extend parallel to first sidewall 170 or second sidewall 172. Additionally, or alternatively, the vertical housing flanges 179 may not extend from the top to the bottom of housing 178, but may have a shorter height (e.g., only half the height of housing 178). In further embodiments, housing flanges 179 may not be vertically contiguous, but may be divided into two or more portions (e.g., a housing flange 179 extending from each corner of the surface of housing 178 facing first sidewall 170 or second sidewall 172). Those of ordinary skill will recognize that other arrangement of housing flanges 179 that aid in fitment (as further described herein) and support of height adjustment assembly 177 are intended to fall within the scope of the present disclosure.

Figure 4A:
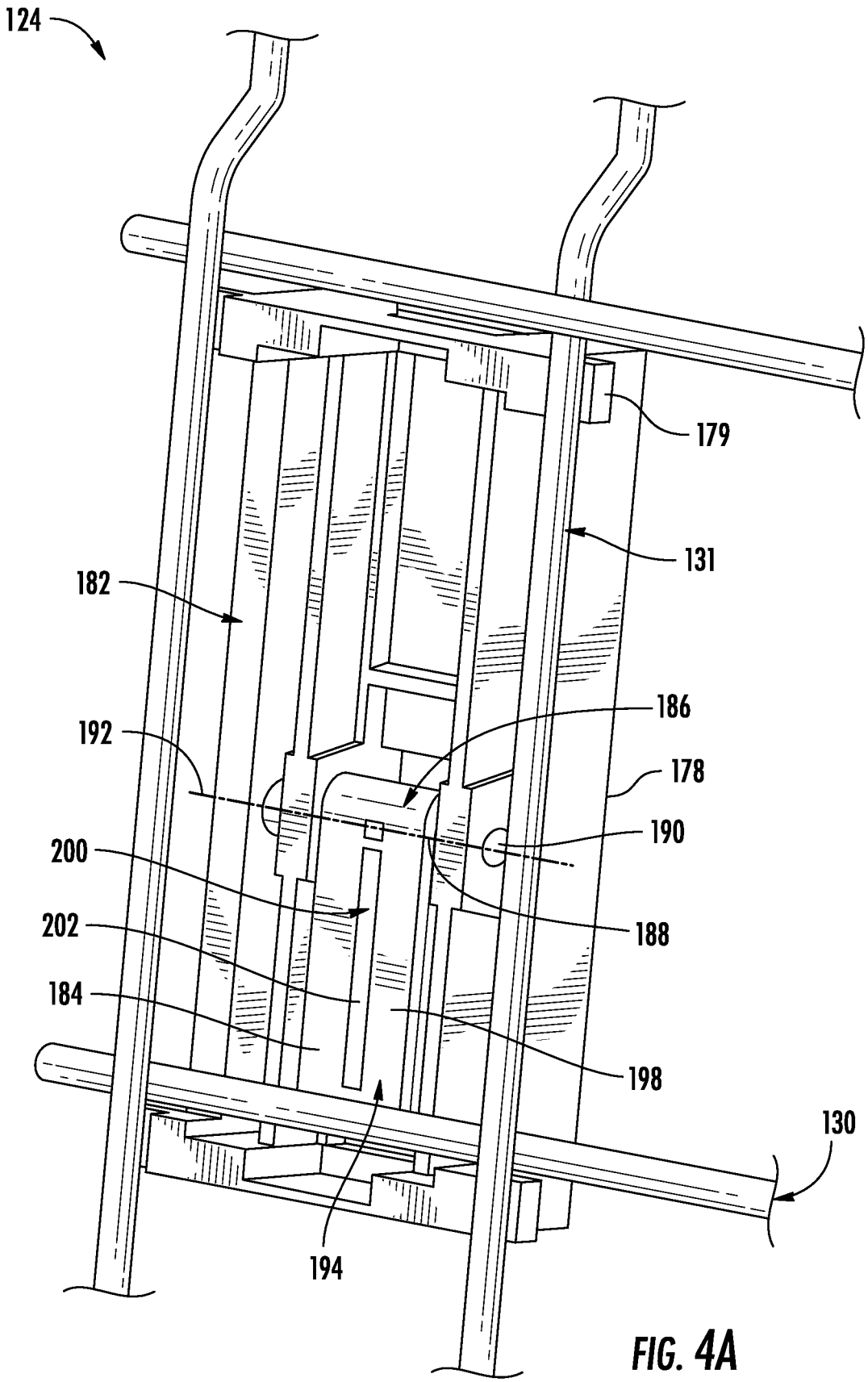
FIG. 4A provides a perspective internal view of a leverless height adjustment assembly according to an exemplary embodiment of the present disclosure wherein a rack is in the lowered position.

Additionally, in some embodiments, height adjustment assembly 177 may include one or more covers 180. Each cover 180 is situated within rack interior 174 and in contact with first sidewall 170 or second sidewall 172 of rack assembly 124. Each of the covers 180 may be connected to the one or more housings 178 through first sidewall 170 or second sidewall 172 by conventional means (e.g., snap-fit, screws, nuts and bolts, etc.). In some embodiments, such as shown in FIG. 3, a single cover 180 may attach to a single housing 178. However, in alternative embodiments, for example, multiple covers 180 may be connect to a single housing 178 or vice versa. Cover 180 and housing 178, once connected, define a housing chamber 182 (FIG. 4A). Cover 180 and housing 178 are sized such that at least one of the plurality of horizontal wires 130 of the first sidewall 170 or the second sidewall 172 of rack assembly 124 extends through housing chamber 182.

Where cover 180 meets first sidewall 170 or second sidewall 172, cover 180 may include two cover flanges 181 extending vertically from the top to the bottom of cover 180 and spaced apart from one another transversely. One of the cover flanges 181 may extend from the furthest forward transverse surface of cover 180 (i.e., from the perspective of the front of dishwasher appliance 10). The other of the cover flanges 181 may extend from the further rearward transverse surface of cover 180. In some embodiments, cover flanges 181 may flare at an angle away from first sidewall 170 or second sidewall 172 (e.g., at a 45 degree angle to first sidewall 170 or second sidewall 172). In alternative embodiments, cover flanges 181 may extend parallel to first sidewall 170 or second sidewall 172. Additionally, or alternatively, the vertical cover flanges 181 may not extend from the top to the bottom of cover 180, but may have a shorter height (e.g., only half the height of cover 180). In further embodiments, cover flanges 181 may not be vertically contiguous, but may be divided into two or more portions (e.g., a cover flange 181 extending from each corner of the surface of cover 180 facing first sidewall 170 or second sidewall 172). Those of ordinary skill will recognize that other arrangement of cover flanges 181 that aid in fitment (as further described herein) and support of height adjustment assembly 177 are intended to fall within the scope of the present disclosure.

Upon connection of housing 178 and cover 180, housing flanges 179 and cover flanges 181 may be aligned with each on opposite sides of first sidewall 170 or second sidewall 172. Housing flanges 179 and cover flanges 181 may be spaced apart from one another in the lateral direction a distance greater than the diameter of the plurality of vertical wires 131. Additionally, the forward and rearward housing flanges 179 and cover flanges 181 are spaced apart from each other in the transverse direction at a distance less than the space between consecutive ones of the plurality of vertical wires 131. As such, consecutive wires of the plurality of vertical wires 131 may be fit between each aligned pair of housing flanges 179 and cover flanges 181, as shown in the embodiment of FIG. 3. In embodiments employed flared housing flanges 179 and cover flanges 181, assembly of height adjustment assembly 177 to rack assembly 124 is eased as variability in the diameter of the plurality of vertical wires 131 does not hinder such attachment. Together, housing flanges 179 and cover flanges 181 prevent substantial transverse and lateral movement of height adjustment assembly 177 relative to rack assembly 124.

Within housing chamber 182, one or more cams 184 may be situated as shown, for example, in the embodiments of FIGS. 4A, 5A, 7A, and 8A. Each cam 184 may include a first end 186 and a second end 194. First end 186 of each cam 184 may further include an opening or through hole 188. A shaft 190 may extend through opening 188, shaft 190 having a longitudinal axis 192. In some embodiments, shaft 190 may be separate from opening 188 such that the components are capable of moving independent of one another. In alternative embodiments, opening 188 and shaft 190 may be integrally formed as a single component. Each cam 184 may be pivotable about axis 192 of shaft 190 such that each cam 184 is rotatable between at least a passive position and a retaining position, as further described herein. Second end 194 of each cam 184 is spaced apart from first end 186 and further includes a retaining surface 196. Retaining surface 196 (as shown, for example, in FIGS. 4C, 5C, 7C, and 8B) provides support to rack assembly 124 when rack assembly 124 is in the raised position, as further addressed herein.

Additionally, each cam 184 includes a cam body 198. Cam body 198 may extend from first end 186 to second end 194 of each cam 184. Cam body 198, considered in isolation, may be hollow such that cam body 198 defines an internal cam chamber 200.

A magnet 202 may be contained within cam chamber 200. Magnet 202 produces a magnetic field that exerts an attraction force on the one of the plurality of horizontal wires 130 of the first sidewall 170 or the second sidewall 172 of the metallic rack assembly 124 within housing chamber 182 when the one of the plurality of horizontal wires 130 is within the magnetic field. This may vary depending on the type of magnet and material of the rack, however it is intended that the magnetic field is small and the attractive force of magnet 202 is applied to the one of the plurality of horizontal wires 130 when the two are in close proximity (e.g., within 1 inch). In this way, and as further described herein, magnet 202 is attracted to rack assembly 124 as it is lifted from a lowered position to a raised position, causing each cam 184 to pivot from its passive position to its retaining position. Each cam 184 may be configured to support the one of the plurality of horizontal wires 130 of first sidewall 170 or second sidewall 172 of rack assembly 124 when the cam 184 is in the retaining position.

Employing the height adjustment assembly 177 and other elements of dishwasher appliance 10 described above, a variety of techniques for lifting and lowering of rack assembly 124 may be employed, including techniques involving manually or mechanically lifting and lowering rack assembly 124. FIGS. 4A-4D provide an illustration of one embodiment associated with manual lifting and lowering of rack assembly 124. In this embodiment, a single cam 184 is contained within housing chamber 182. FIG. 4A shows cam 184 in the passive position and rack assembly 124 in the lowered position. Notably, magnet 202 of cam 184 is in close proximity to the one of the plurality of horizontal wires 130 within housing chamber 182.

Figure 4B:
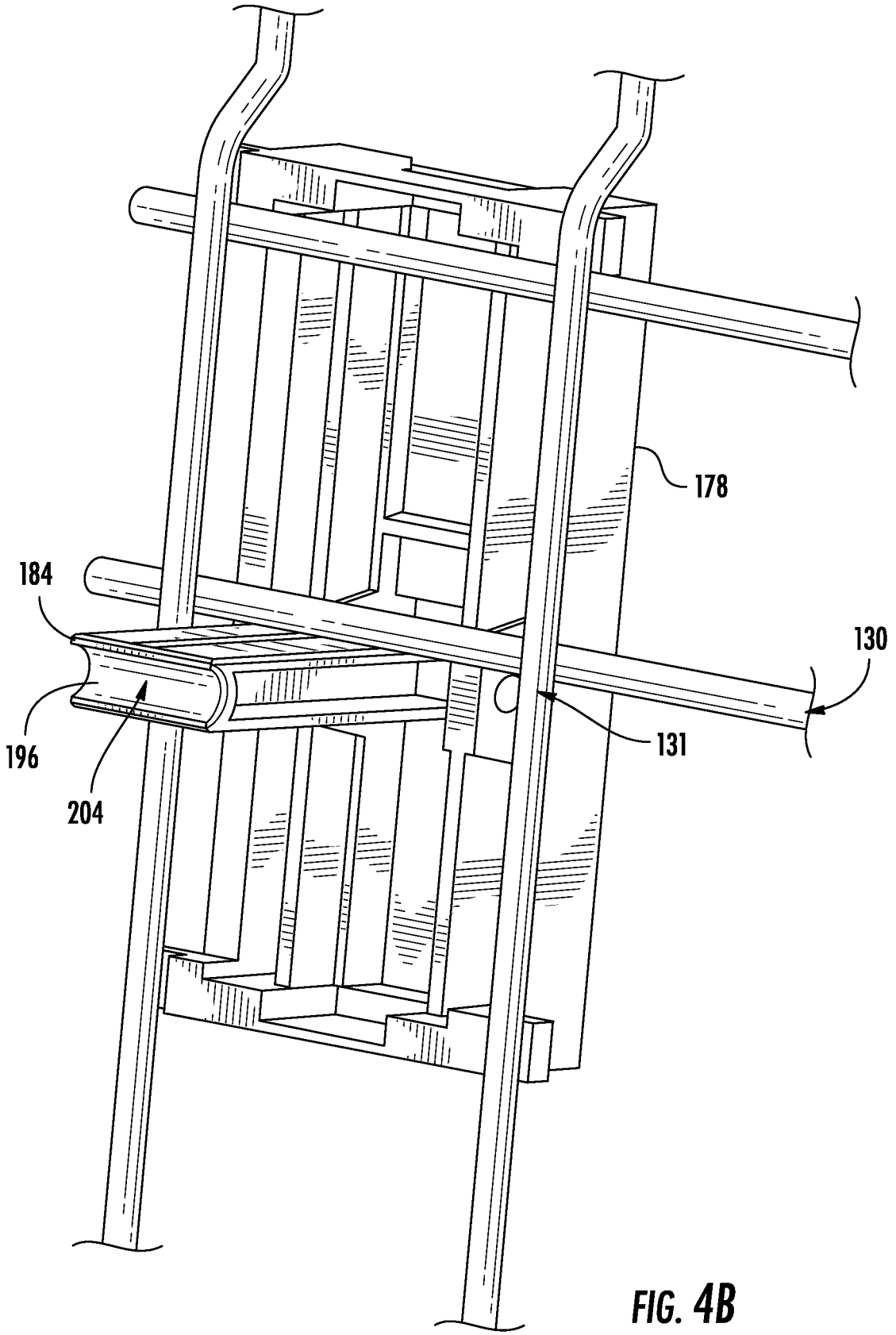
FIG. 4B provides a perspective internal view of a leverless height adjustment assembly according to an exemplary embodiment of the present disclosure wherein a rack is being raised.

To raise rack assembly 124, a user manually lifts rack assembly 124 in this embodiment. As rack assembly 124 is lifted vertically, the one of the plurality of horizontal wires 130 passes within close proximity to magnet 202 and through the magnetic field of magnet 202 in cam 184, attracting these elements together. As the user continues to lift rack assembly 124, the one of the plurality of horizontal wires 130 pulls magnet 202 upward, causing cam 184 to pivot about shaft 190, as illustrated in FIG. 4B. Once the one of the plurality of horizontal wires 130 is lifted to the height of second end 194 of cam 184, cam 184 has rotated to retaining position, wherein the retaining position is a primarily vertical position (e.g., less than 25 degrees from vertical). The one of the plurality of horizontal wires 130 may then be lowered slightly onto retaining surface 196 at second end 194 of cam 184. In this position, rack assembly 124 is in the raised position. Because rack assembly 124 is prevented from moving laterally, as previously described, cam 184 serves to support rack assembly 124 in the raised position, as illustrated in FIG. 4C.

Figure 4C:
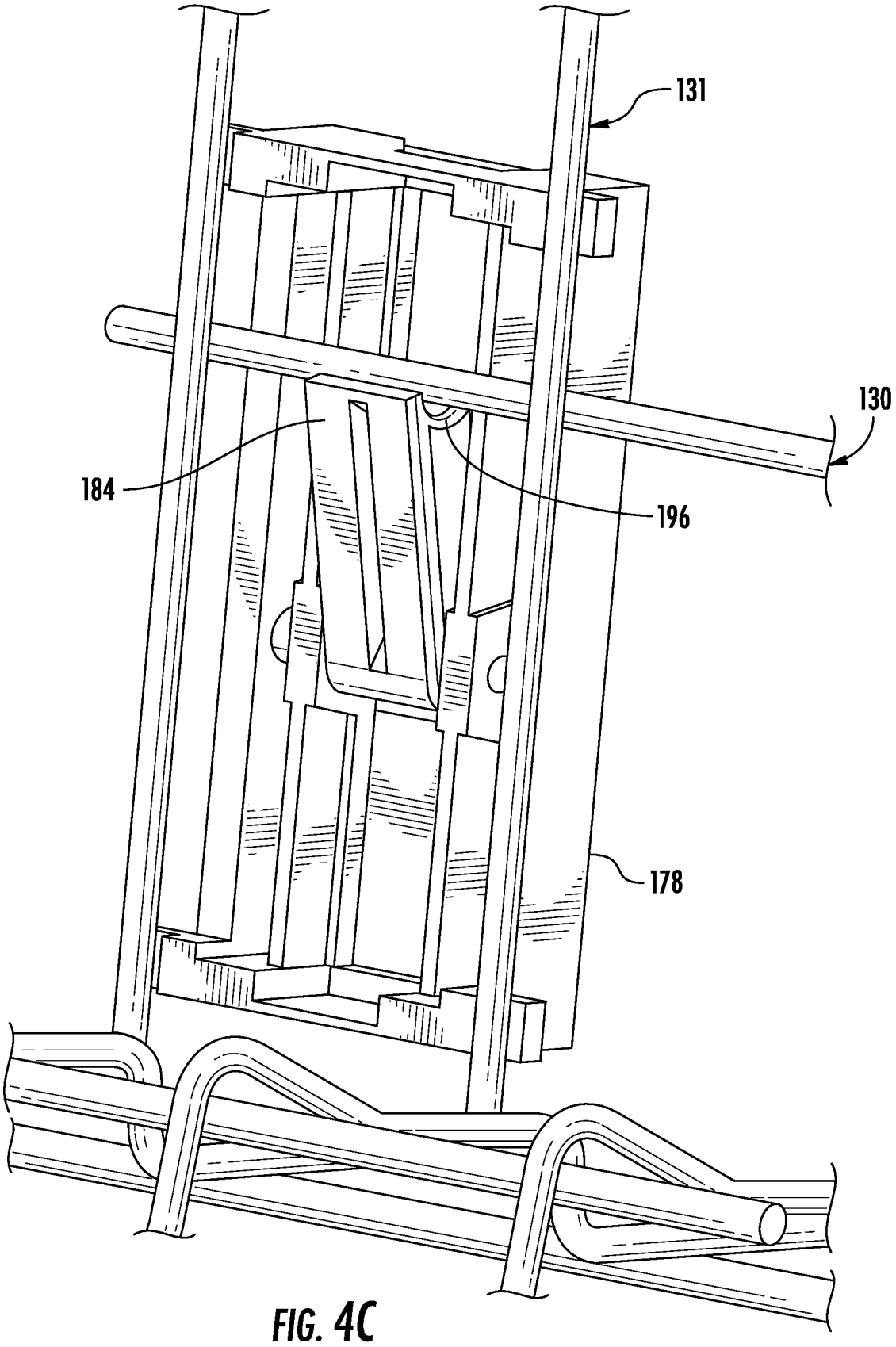
FIG. 4C provides a perspective internal view of a leverless height adjustment assembly according to an exemplary embodiment of the present disclosure wherein a rack is in the raised position.
Figure 4D:
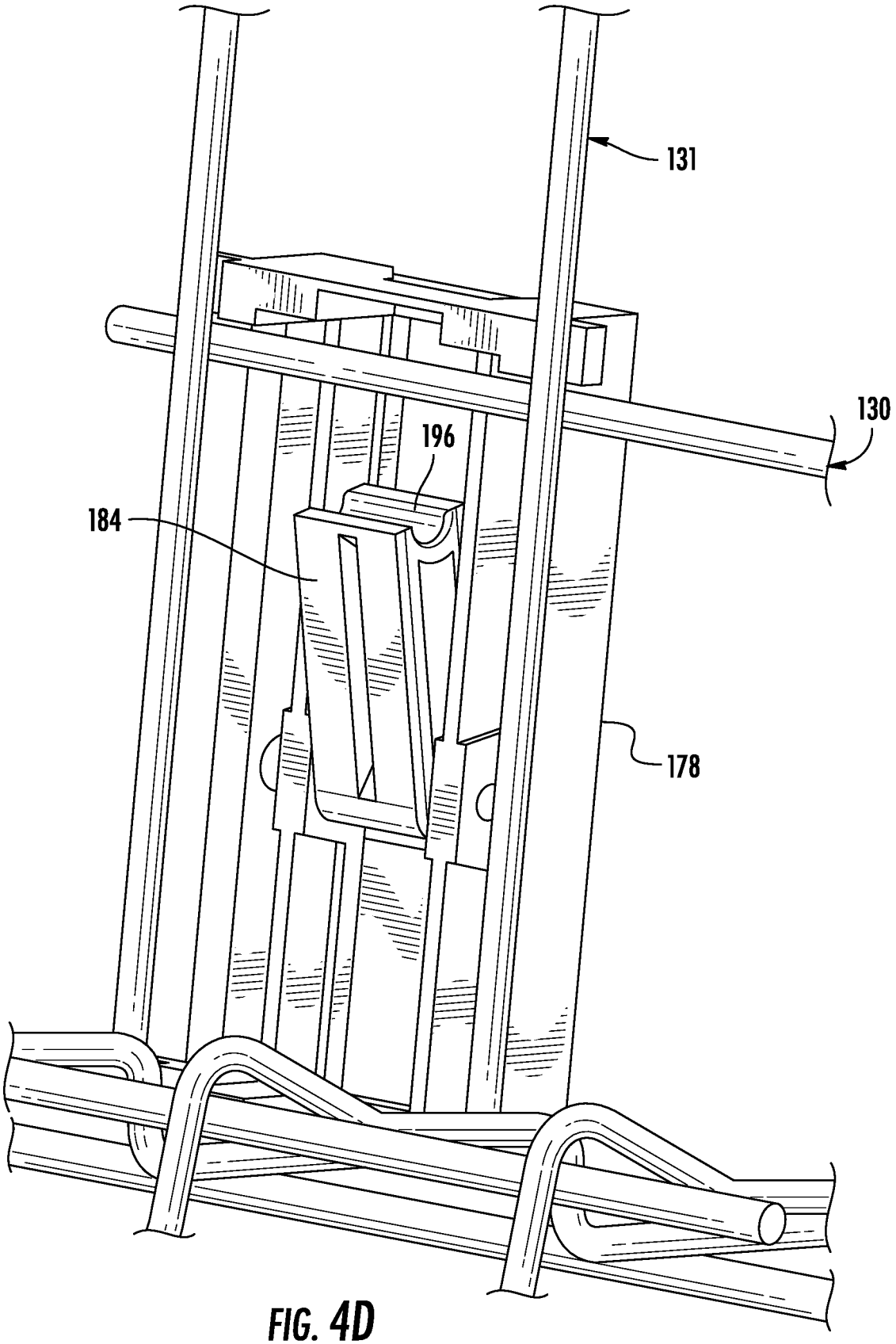
FIG. 4D provides a perspective internal view of a leverless height adjustment assembly according to an exemplary embodiment of the present disclosure wherein a rack is in the release position.

In one embodiment, such as shown in FIG. 4C, retaining surface 196 of each cam 184 may form a depression 204 along a portion or the entirety of retaining surface 196. Depression 204 is wide enough in the lateral direction (when cam 184 is in the retaining position) to accommodate the entire diameter of the one of the plurality of horizontal wires 130. Thus, when rack assembly 124 is in the raised position, depression 204 receives the one of the plurality of horizontal wires 130. That is, the one of the plurality of horizontal wires 130 is at least partially contained within depression 204. In alternative embodiments, retaining surface may be substantially flat.

To lower rack assembly 124 back to the lowered position, a user may initially lift rack assembly 124 to the release position. Thus, the release position of rack assembly 124 is higher than the raised position of rack assembly 124. Lifting of rack assembly 124 from the raised position raises the one of the plurality of horizontal wires 130. Because cam 184 is already substantially vertical, it can no longer rotate to remain magnetically attached to the one of the plurality of horizontal wires 130. Accordingly, as the one of the plurality of horizontal wires 130 is raised out of the magnetic field of magnet 202, the attraction force between the two is broken. With the cessation of the magnetic force on cam 184, gravity causes cam 184 to fall, pivoting about shaft 190 until it returns to the passive position. Since cam 184 no longer provides support, the user may then manually lowers rack assembly 124 to the lowered position.

An alternative embodiment employing the height adjustment assembly 177 and other elements of dishwasher appliance 10 is illustrated is illustrated in FIGS. 5A-5E and 6. In this embodiment dishwasher appliance 10 further includes a first lever 206 for mechanically raising and lowering rack assembly 124. First lever 206 may include a first handle portion 208, a connecting portion 210, and a lifting portion 212. First handle portion 208 is connected to lifting portion 212 at connecting portion 210. First handle portion 208 and lifting portion 212 are connected at a fixed angle such that rotation of first handle portion 208 about the lateral axis also rotates lifting portion 212 about the later axis to the same degree.

Lifting portion 212 of first lever 206, in this embodiment, may further include a lever rotation protrusion 214, a rack lifting protrusion 216, and a shaft pushing protrusion 218. Lever rotation protrusion 214 may extend from lifting portion 212 of first lever 206 laterally in the direction of rack assembly 124. Lever rotation protrusion 214 may further be positioned above the one of the plurality of horizontal wires 130 within housing chamber 182. Rack lifting protrusion 216 may also extend from lifting portion 212 of first lever 206 laterally in the direction of rack assembly 124. Rack lifting protrusion 216 may further be positioned below the one of the plurality of horizontal wires 130 within housing chamber 182. Shaft pushing protrusion 218 may extend radially outward from connecting portion 210 of first lever 206 and substantially orthogonal to lifting portion 212 of first lever 206 such that pivoting of first lever 206 rotates shaft pushing protrusion 218 between a substantially horizontal position and a substantially vertical position.

First lever 206 may be pivotable about a lateral axis extending through connecting portion 210. Additionally, first handle portion 208 of first lever 206 may be configured to flex inward in the lateral direction (i.e., toward rack assembly 124). Exercising these degrees of freedom, first lever 206 may be moveable between a lower rack position, a raise rack position, a resting raised rack position, and a resting lowered rack position, as further described herein.

Figure 6:
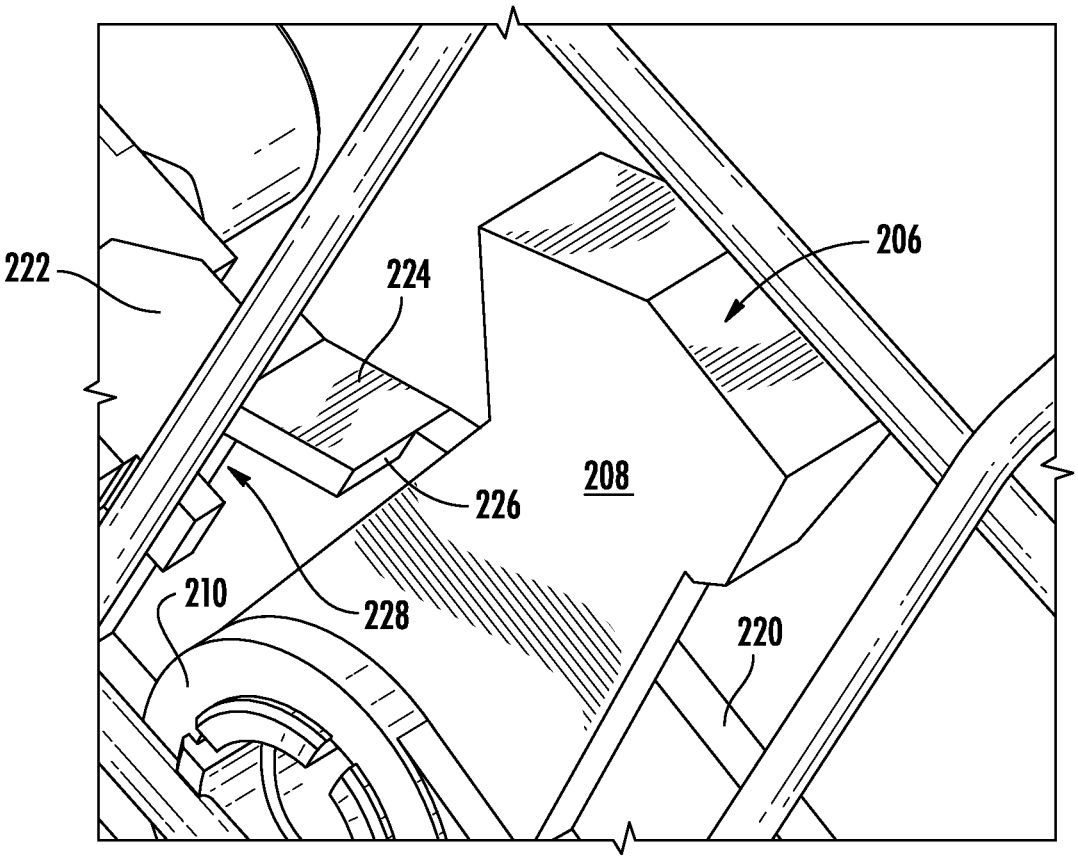
FIG. 6 provides a perspective view of a lever and housing according to an exemplary embodiment of the present disclosure.

As shown most clearly in the embodiment of FIG. 6, housing 178 of height adjustment assembly 177 may further include a housing sidewall 220, a housing back wall 222, and a wall stop 224. Housing sidewall 220 may be a primarily transversely and vertically extending surface of housing 178 and may be separated from rack assembly 124 by first lever 206. Housing back wall 222 may be a primarily transversely and laterally extending surface of housing 178. Housing back wall 222 may be situated behind lever 206 (from the perspective of the front of dishwashing appliance 10) and may be orthogonally connected along one side to housing sidewall 220 such that housing sidewall 220 and housing back wall 222 together at least partially define an opening in housing 182 within which first handle portion 208 of first lever 206 may move. Wall stop 224 may extend laterally from housing sidewall 220 and transversely from housing back wall 222, thus occupying a portion of the opening within which first handle portion 208 of first lever 206 may move. The portion of wall stop 224 extending laterally defines a lip 226. Lip 226 is situated such that it interferes with the rotational movement of first handle portion 208 of first lever 206. The portion of wall stop 224 extending transversely cooperates with housing back wall 222 to at least partially define an offset space 228 further rearward in dishwashing appliance than lip 226, but offset in the lateral direction.

Referring again to the embodiments of FIGS. 5A-5E, the one or more cams 184 includes two cams 184 in this embodiment. The two cams 184 are spaced apart in the transverse direction and share a common shaft 190 about which both cams 184 may pivot. Additionally, in this embodiment, housing 178 further includes a volume 230 extending transversely at least as long as the length of shaft 190. This volume 230 may generally be hollow except for shaft 190 so as to permit the entirety of shaft 190 to move vertically within the volume 230 for at least a short distance (e.g., around 1-3 inches).

Figure 5A:
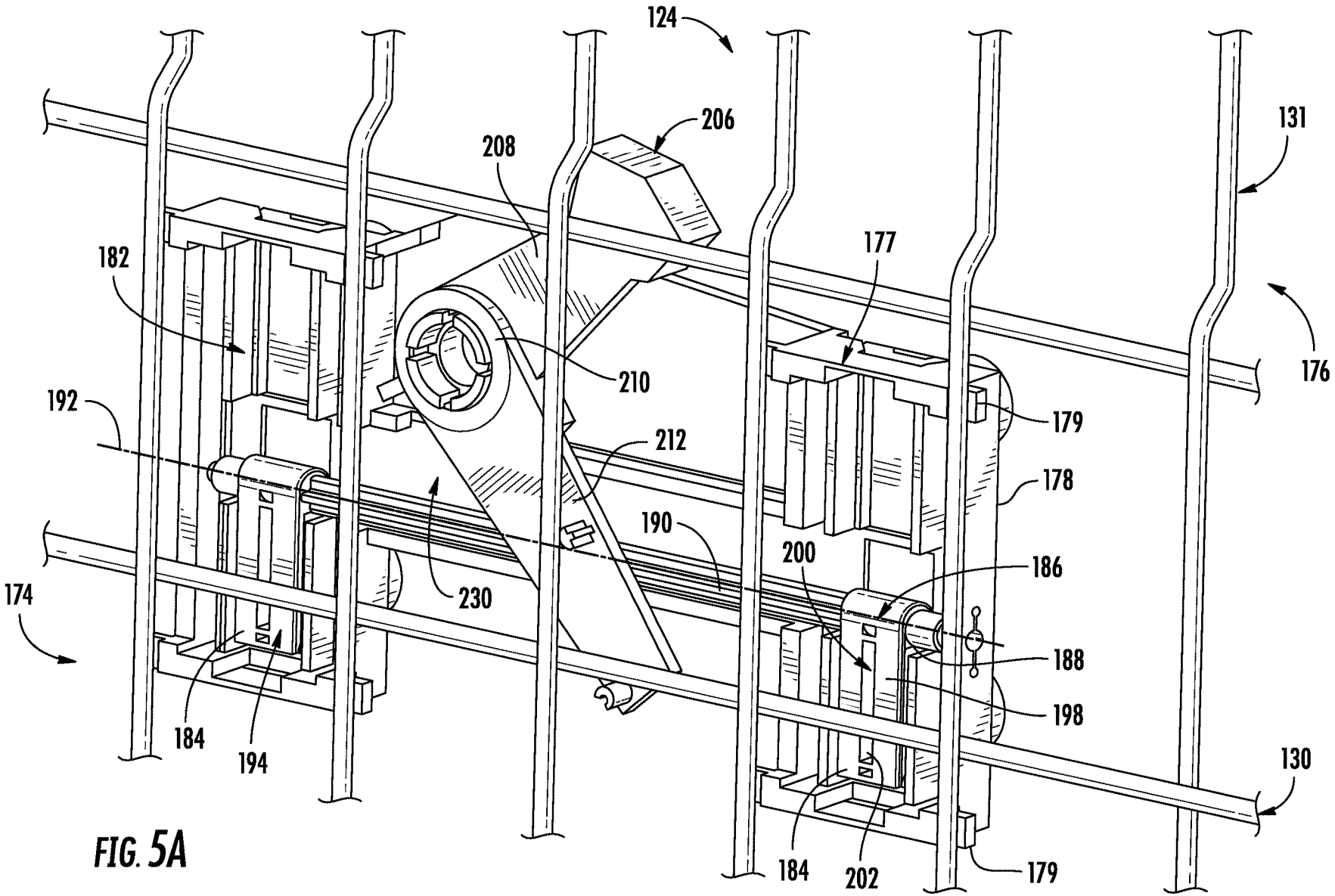
FIG. 5A provides a perspective internal view of a height adjustment assembly with a single lever according to an exemplary embodiment of the present disclosure wherein a rack is in the lowered position.

FIG. 5A illustrates the above-described embodiment with the rack assembly 124 in the lowered position, cams 184 in the passive position, and first lever in the resting lowered rack position. It will be noted that the one of the plurality of horizontal wires 130 is supported by rack lifting protrusion 216 (identified in FIG. 5B). While the weight of rack assembly 124 would tend to rotate first lever 206, such rotation is prevented by lever rotation protrusion 214 which, in this position, is prevented from moving by one of the plurality of vertical wires 131. It should further be recognized that the one of the plurality of horizontal wires 130 is in close proximity to magnet 202 of cams 184.

Figure 5B:
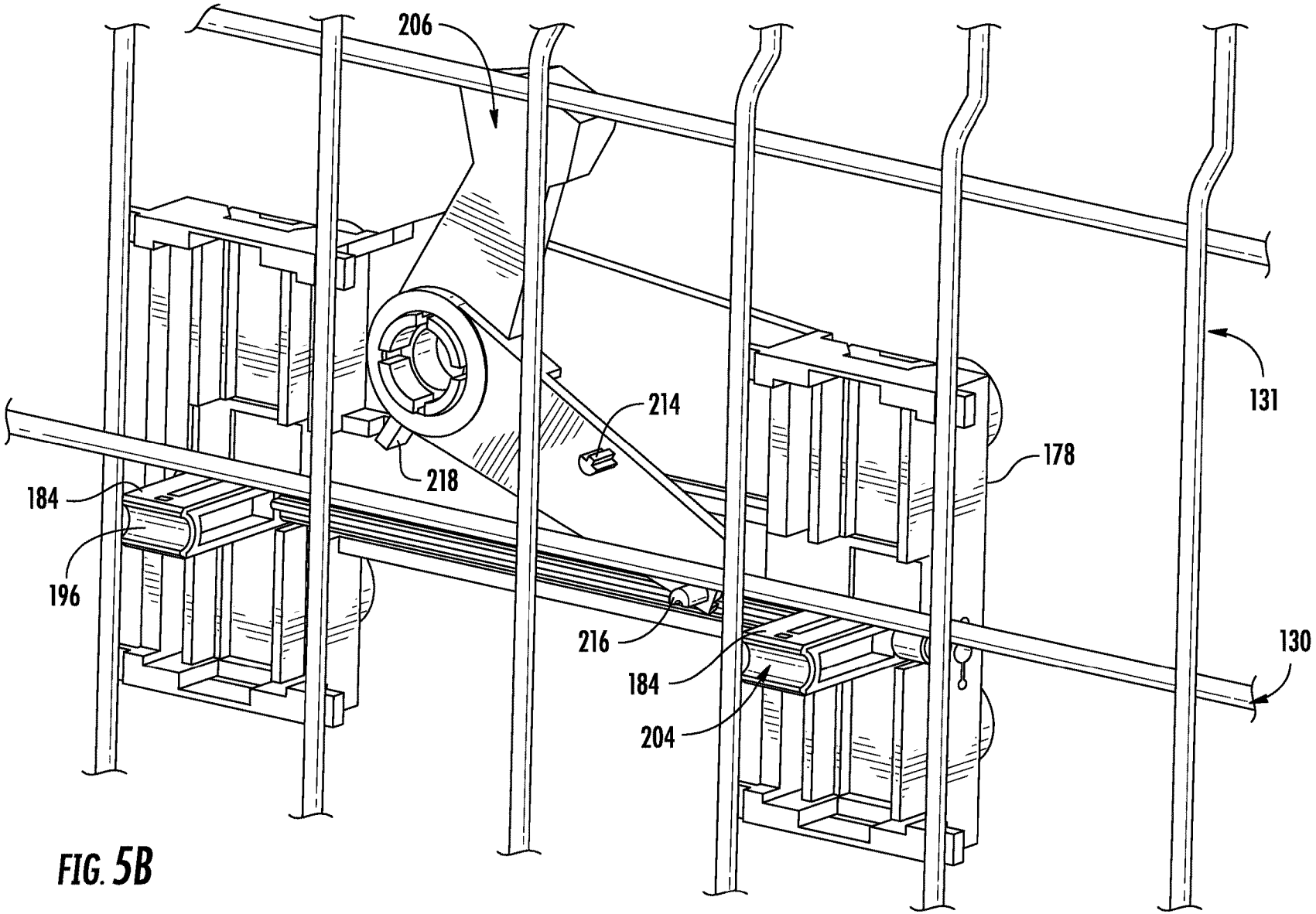
FIG. 5B provides a perspective internal view of a height adjustment assembly with a single lever according to an exemplary embodiment of the present disclosure wherein a rack is in being raised.

When it is desirable to lift rack assembly 124, first lever 206 is rotated by the user in the rearward direction (from the perspective of the front of dishwashing appliance 10) to the raise rack position by applying a force in the transverse direction to first handle portion 208. As lever 206 is pushed, lifting portion 212 of first lever 206 rotates upward, causing rack lifting protrusion 218 to push the one of the plurality of horizontal wires 130 upward, lifting the entire rack assembly 124, as shown in FIG. 5B. As the one of the plurality of horizontal wires 130 is raised, magnets 202 of cams 184 are pulled by magnetic force, causing cams 184 to rotate about shaft 190, as also shown in FIG. 5B. It should be noted that, in addition to rotating cams 184, the attraction between magnets 202 and the one of the plurality of horizontal wires 130 also causes cams 184 to be raised. Because cams 184 are attached to shaft 190, lifting of cams 184 also lifts shaft 190 within volume 230.

Figure 5C:
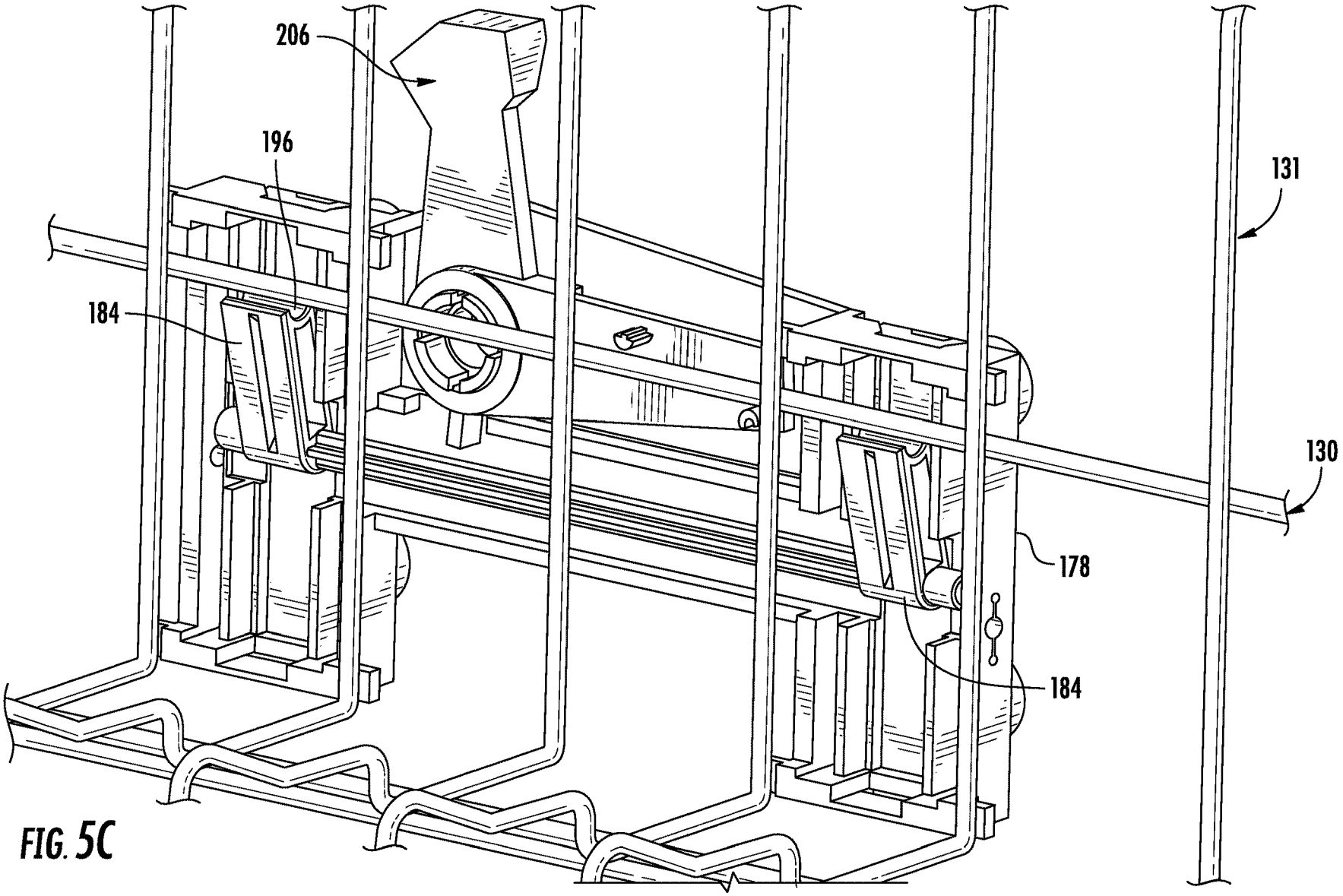
FIG. 5C provides a perspective internal view of a height adjustment assembly with a single lever according to an exemplary embodiment of the present disclosure wherein a rack is being further raised.
Figure 5D:
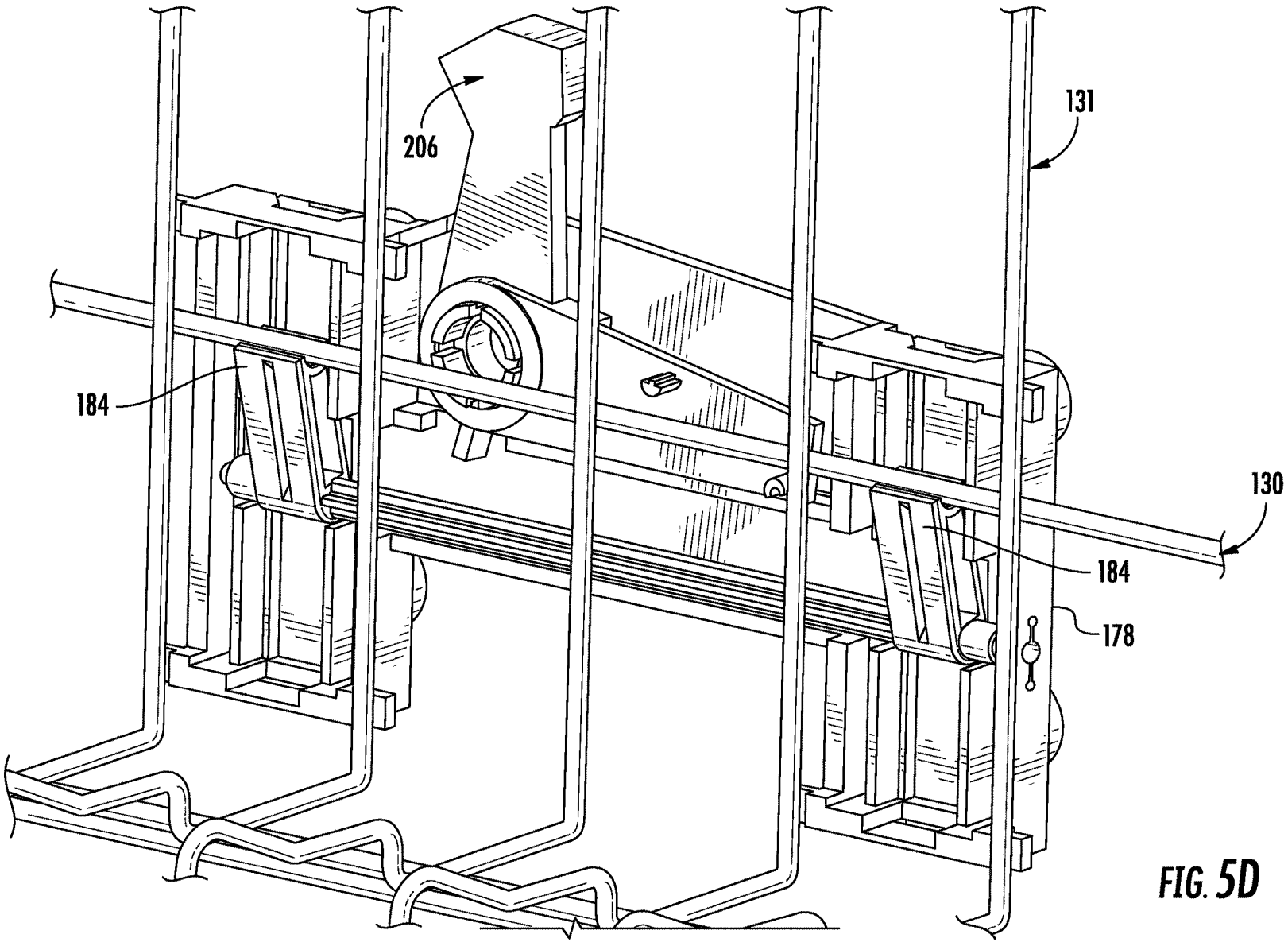
FIG. 5D provides a perspective internal view of a height adjustment assembly with a single lever according to an exemplary embodiment of the present disclosure wherein a rack is in the raised position.

As illustrated in the embodiment of FIG. 5C, first lever 206 continues to be rotated by the user until its path is interfered with by lip 226 of wall stop 224. First lever 206 is configured such that when first handle portion 208 of lever 206 contacts lip 226, rack lifting protrusion 216 supports the one of the plurality of horizontal wires 130 at height just above a substantially vertical cams 184 (e.g., less than 25 degrees from vertical). Upon reaching this point, cams 184 are in the retaining position. It will be recognized that cams 184 only reach the retaining position once shaft 190 has reached the uppermost portion of volume 230 and its vertical movement has been halted. The user may then release first lever 206, which may rotate in the opposite direction due to the weight of rack assembly 124 on rack lifting protrusion 216, as shown in FIG. 5D. Thus, rack assembly 124 may lower slightly until the one of the plurality of horizontal wires 130 contacts retaining surfaces 196 of cams 184, pushing shaft 190 down to the lowermost portion of volume 230, where its vertical movement is halted. In this position, shaft 190 vertically supports cams 184 which in turn support rack assembly in the raised position. As in the prior embodiment, retaining surfaces 196 of cams 184 may form depressions 204 that aid in retaining rack assembly 124 while supported in the raised position, although such is not required by the present disclosure. Additionally, it will be noted that lever rotation protrusion 214 of first lever 206, which is now in the resting raised rack position, prevents lever 206 from rotating back to its original position because it comes into contact with the one of the plurality of horizontal wires 130.

Figure 5E:
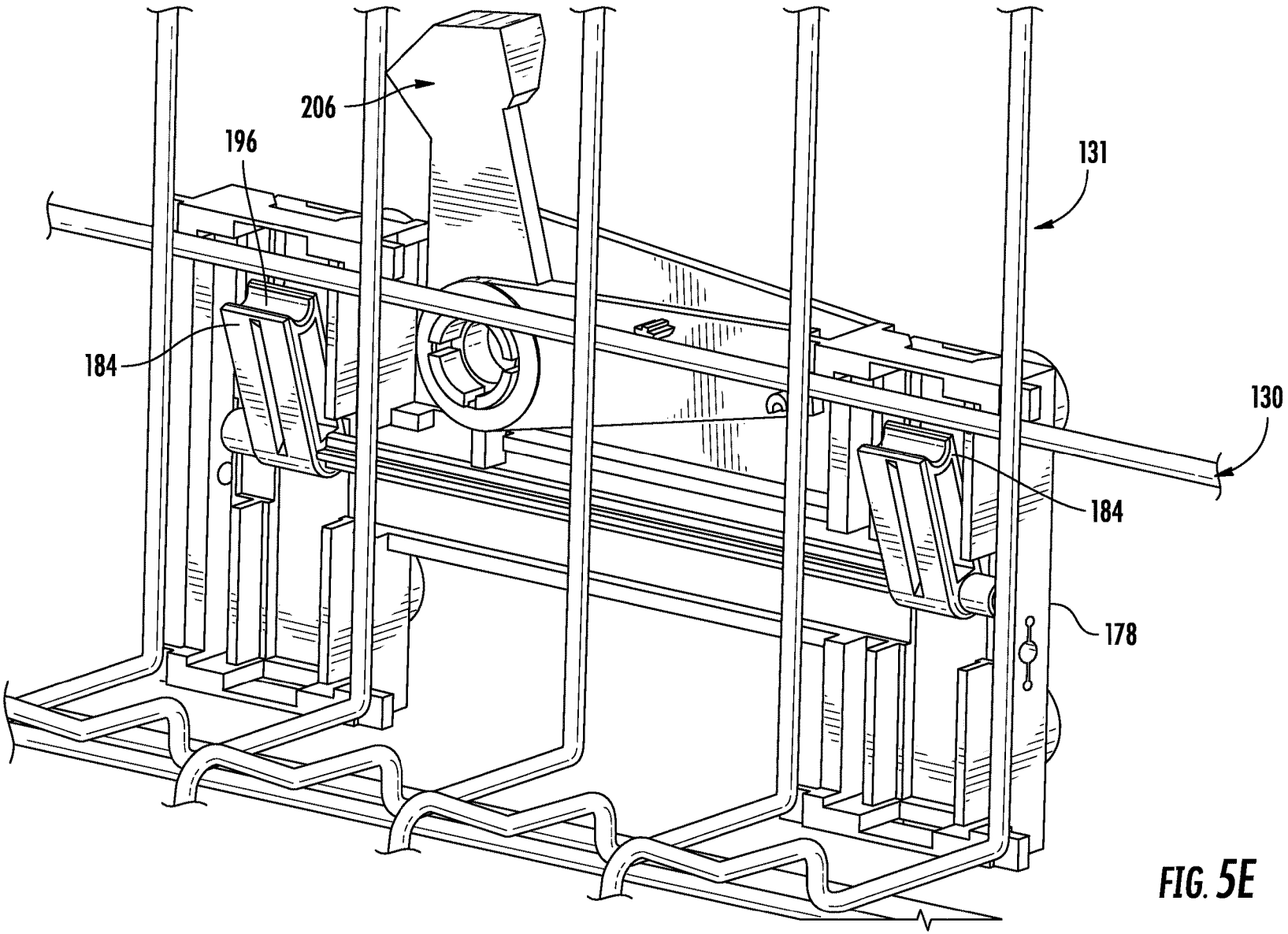
FIG. 5E provides a perspective internal view of a height adjustment assembly with a single lever according to an exemplary embodiment of the present disclosure wherein a rack is in the release position.

First lever 206 may further be manipulated by the user to lower rack assembly 124 as shown in the embodiment of FIG. 5E. In particular, when it is desirable to lower rack assembly 124, the user flexes first handle portion 208 of first lever 206 inward toward rack assembly 124, bypassing lip 226 and aligning first handle portion 208 with offset space 228. The user may then rotate first lever 206 further rearward and into offset space 228 to achieve the lower rack position of first lever 206. This rotation of first lever 206 causes rack lifting protrusion 216 to apply a vertical force lifting the one of the plurality of horizontal wires 130 and thus rack assembly 124 to the release position.

The magnets 202 of cams 184 initially maintain an attraction to the one of the plurality of horizontal wires 130, thus lifting cams 184 and shaft 190 as rack assembly 124 is lifted. However, first lever 206 is configured such that rotation of first handle portion 208 into offset space 228 causes shaft pushing protrusion 218 to extend substantially vertically. Shaft pushing protrusion 218 is so dimensioned that, in the substantially vertical position, it pushes shaft 190 downward, thereby also push cams 184 downward to the extent that the magnetic attraction between magnets 202 and the one of the plurality of horizontal wires 130 is broken. At this point, gravity causes shaft 190 to fall to the lowermost portion of volume 230 and cams 184 to pivot back to the passive position. Thereafter, the user may gradually release the lever and, in the absence of cams 184 for support, the weight of rack assembly 124 on rack lifting protrusion 216 causes first lever 206 to rotate back to its original position and wherein rack assembly 124 returns to the lowered position. In this embodiment, rack assembly 124 is support by housing 178, but in alternative embodiments, rack assembly 124 may be supported by rack lifting protrusion 216 or an alternative protrusion.

Yet another alternative embodiment employing the height adjustment assembly 177 and other elements of dishwasher appliance 10 is illustrated is illustrated in FIGS. 7A-7E. In this embodiment dishwasher appliance 10 further includes a dual handle assembly 232 including a first lever 206 for mechanically raising rack assembly 124 and a second lever 234 for mechanically lowering rack assembly 124. In this embodiment, first lever 206 may include a first handle portion 208 and a first lever body 236. First handle portion 208 may be fixedly connected to first lever body 236. Additionally, first lever body may further include a first lever rotation protrusion 244 and a rack lifting protrusion 246. Lever rotation protrusion 244 may extend from first lever body 236 laterally in the direction of rack assembly 124 and be situated above the one of the plurality of horizontal wires 130 of rack assembly 124 within housing chamber 182. Further, rack lifting protrusion 246 may extend from first lever body 236 laterally in the direction of rack assembly 124 and be situated below the one of the plurality of horizontal wires 130 of rack assembly 124 within housing chamber 182.

In this embodiment, second lever 234 may further include a second handle portion 238 and a second lever body 240. Both first lever 206 and second lever 234 are pivotable about common lateral axis extending through first lever body 236 and second lever body 240 at a pivot point 242. Second lever body 240 may be conceptually divided into a first side 248 and a second side 250 on opposite sides of pivot point 242. Second lever body 240 may further include a second lever rotation protrusion 252, a rack lifting protrusion 254, and a shaft pushing protrusion 256. Lever rotation protrusion 252 of second lever 234 may extend from first side 248 of second lever body 240 laterally in the direction of rack assembly 124 and be situated above the one of the plurality of horizontal wires 130 within housing chamber 182. Rack lifting protrusion 254 may extend from first side 248 of second lever body 240 laterally in the direction of rack assembly 124 and be situated below the one of the plurality of horizontal wires 130 within housing chamber 182. Shaft pushing protrusion 256 may extend from second side 250 of second lever body 240 in the direction of rack assembly 124 and be situated such that pivot point 242 is substantially between shaft pushing protrusion 256 and rack lifting protrusion 254. Although it is not necessary that pivot point 242 is directly or precisely between shaft pushing protrusion 256 and rack lifting protrusion 254, they must be on opposite sides of pivot point 242 on second lever body 240 such that, as second lever 234 rotates, shaft pushing protrusion 256 travels in substantially the opposite direction as rack lifting protrusion, as further described herein.

Referring still to the embodiments of FIGS. 7A-7E, the one or more cams 184 includes two cams 184 in this embodiment. The two cams 184 are spaced apart in the transverse direction and share a common shaft 190 about which both cams 184 may pivot.

Figure 7A:
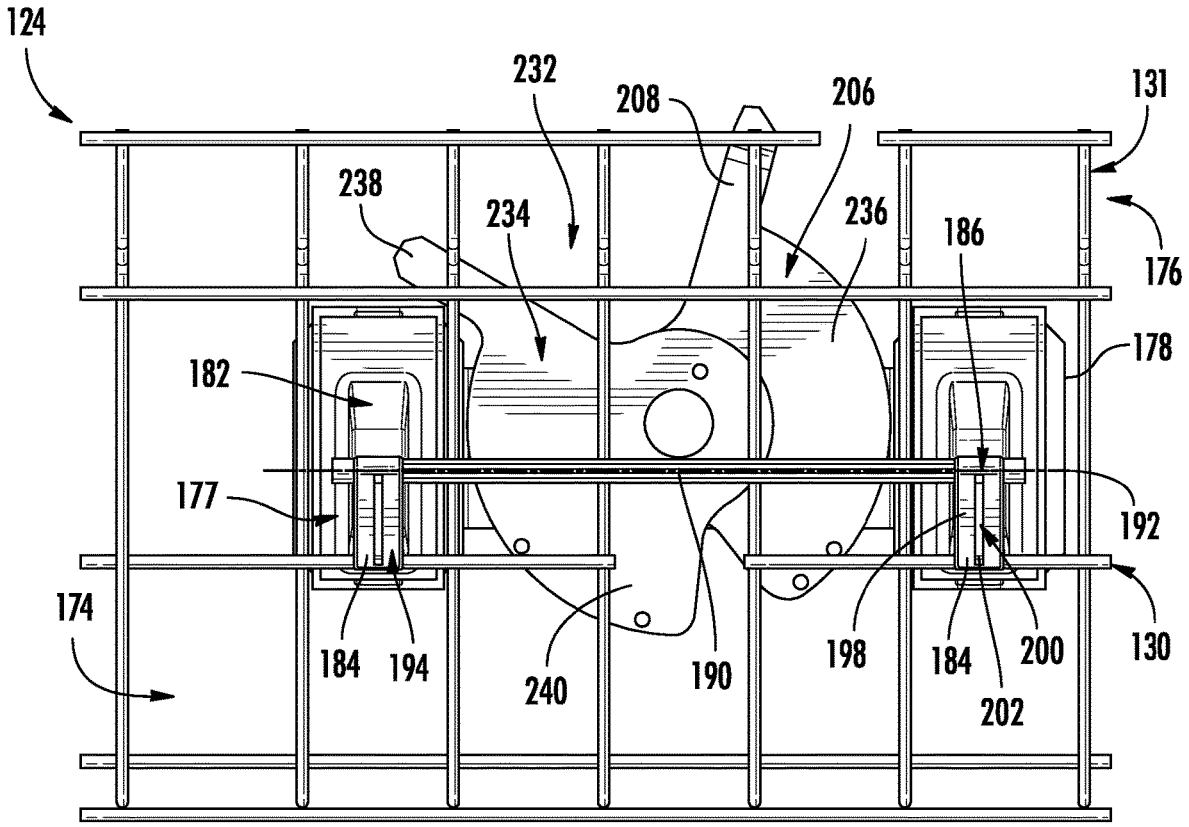
FIG. 7A provides a perspective internal view of a height adjustment assembly with a dual lever assembly according to an exemplary embodiment of the present disclosure wherein a rack is in the lowered position.

FIG. 7A illustrates the above-described embodiment with the rack assembly 124 in the lowered position and cams 184 in the passive position. It will be noted that the one of the plurality of horizontal wires 130 is supported by housing 178. While the weight of rack assembly 124 would tend to rotate first lever 206, such rotation is prevented by first lever rotation protrusion 244 which, in this position, is prevented from moving by one of the plurality of horizontal wires 130. Second lever rotation protrusion 252 also contacts the one of the plurality of horizontal wires 130, thereby preventing further rotation of second lever 234. It should further be recognized that the one of the plurality of horizontal wires 130 is in close proximity to magnet 202 of cams 184.

Figure 7B:
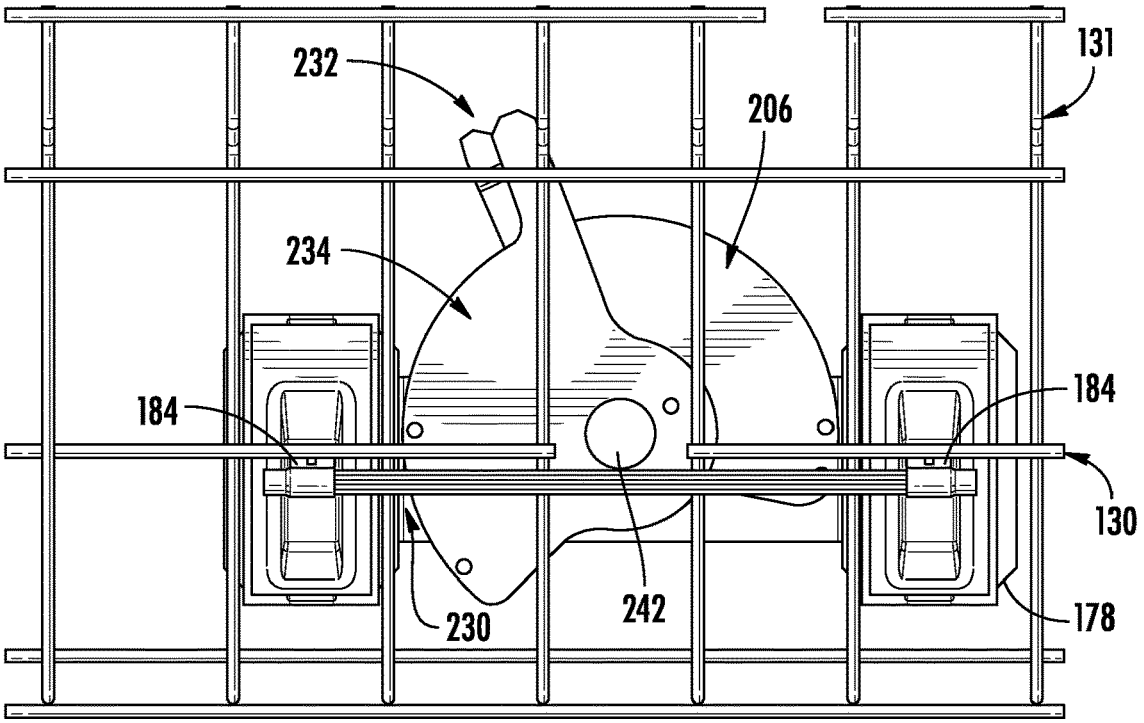
FIG. 7B provides a perspective internal view of a height adjustment assembly with a dual lever assembly according to an exemplary embodiment of the present disclosure wherein a rack is being raised.

When it is desirable to lift rack assembly 124, first lever 206 is rotated by the user in the rearward direction (from the perspective of the front of dishwashing appliance 10) by applying a force in the transverse direction to first handle portion 208. As first lever 206 is pushed, first lever body 240, causing rack lifting protrusion 246 (identified in FIG. 7C) to push the one of the plurality of horizontal wires 130 upward, lifting the entire rack assembly 124, as shown in FIG. 7B. As the one of the plurality of horizontal wires 130 is raised, magnets 202 of cams 184 are pulled by magnetic force, causing cams 184 to rotate about shaft 190, as also shown in FIG. 7B. It should be noted that, in addition to rotating cams 184, the attraction between magnets 202 and the one of the plurality of horizontal wires 130 also causes cams 184 to be raised. Because cams 184 are attached to shaft 190, lifting of cams 184 also lifts shaft 190. Furthermore, as the one of the plurality of horizontal wires 130 is raised, it makes contact with lever rotation protrusion 252 of second lever 234, causing second lever 234 to rotate in the direction opposite the rotation of first lever 206.

Figure 7C:
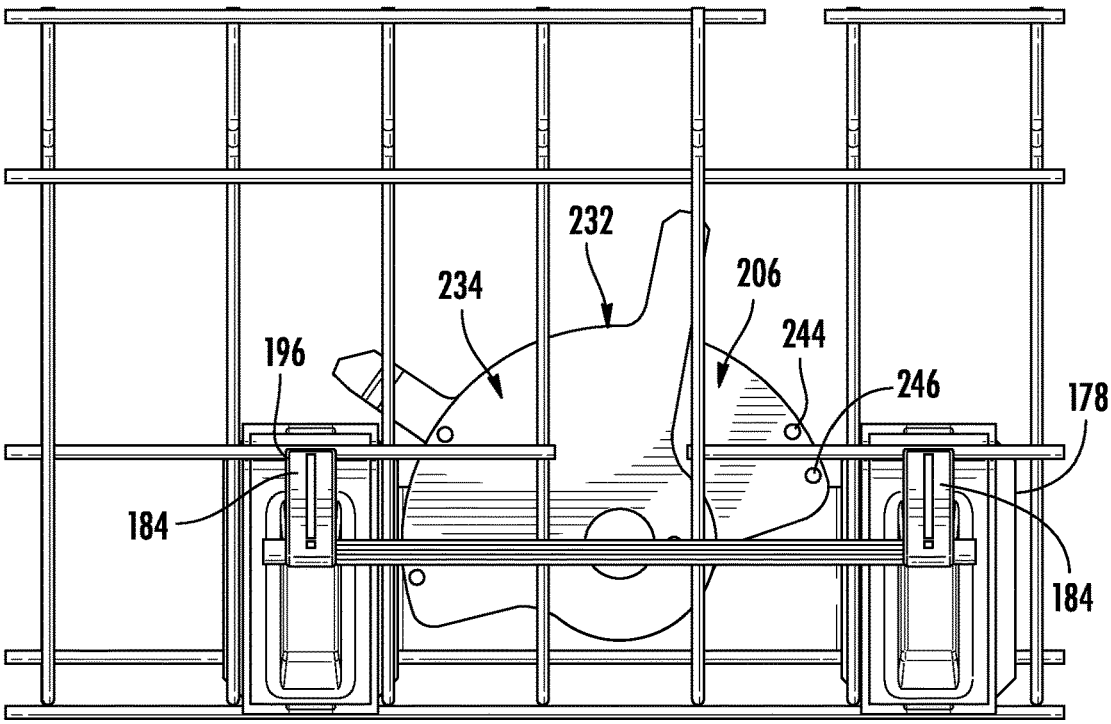
FIG. 7C provides a perspective internal view of a height adjustment assembly with a dual lever assembly according to an exemplary embodiment of the present disclosure wherein a rack is being further raised.
Figure 7D:
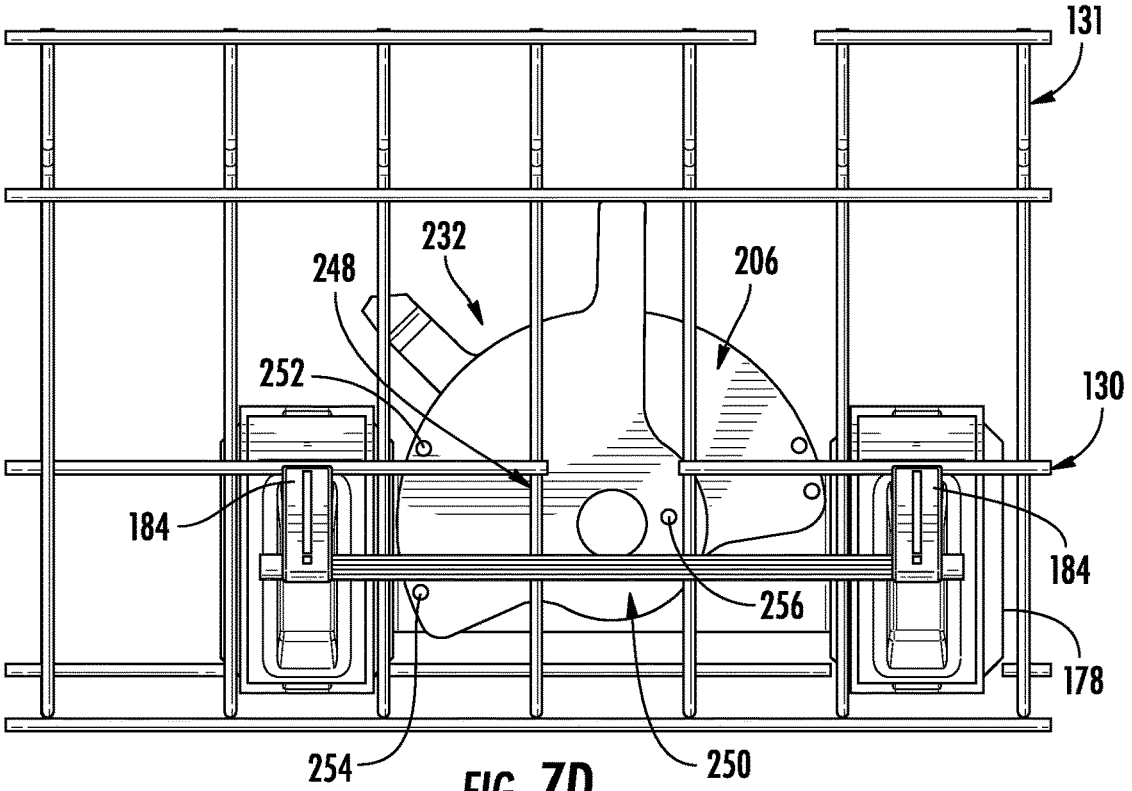
FIG. 7D provides a perspective internal view of a height adjustment assembly with a dual lever assembly according to an exemplary embodiment of the present disclosure wherein a rack is in the raised position.

As illustrated in the embodiment of FIG. 7C, first lever 206 continues to be rotated by the user until its path is interfered with by housing 178. First lever 206 is configured such that when first handle portion 208 of first lever 206 housing 178, rack lifting protrusion 216 supports the one of the plurality of horizontal wires 130 at height just above substantially vertical cams 184 (e.g., less than 25 degrees from vertical). Upon reaching this point, cams 184 are in the retaining position. The user may then release first lever 206, which may rotate in the opposite direction due to the weight of rack assembly 124 on rack lifting protrusion 216, as shown in FIG. 7D. Thus, rack assembly 124 may lower slightly until the one of the plurality of horizontal wires 130 contacts retaining surfaces 196 of cams 184, pushing shaft 190 and cams 184 to their lowest position. In this position shaft 190 vertically supports cams 184 which in turn support rack assembly 124 in the raised position. As in the prior embodiment, retaining surfaces 196 of cams 184 may form depressions 204 that aid in retaining rack assembly 124 while supported in the raised position, although such is not required by the present disclosure.

Figure 7E:
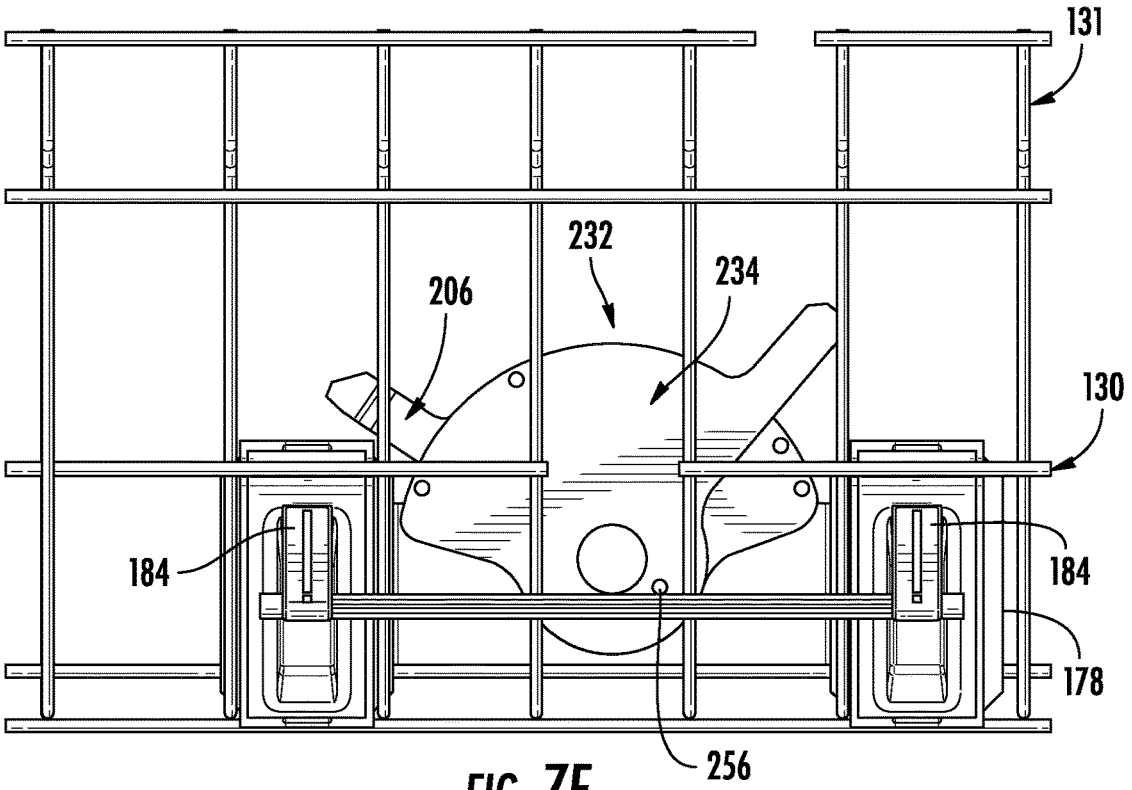
FIG. 7E provides a perspective internal view of a height adjustment assembly with a dual lever assembly according to an exemplary embodiment of the present disclosure wherein a rack is in the release position.

Second lever 234 may be manipulated by the user to lower rack assembly 124 as shown in the embodiment of FIG. 7E. In particular, when it is desirable to lower rack assembly 124, the user pulls second handle portion 238 of second lever 234 forward (e.g., from the perspective of user in front of dishwashing appliance 10). This rotation of second lever 234 causes rack lifting protrusion 246 to apply a vertical force lifting the one of the plurality of horizontal wires 130 and thus rack assembly 124 to the release position.

The magnets 202 of cams 184 initially maintain an attraction to the one of the plurality of horizontal wires 130, thus lifting cams 184 and shaft 190 as rack assembly 124 is lifted. However, second lever 234 is configured such that rotation of second handle portion 238 causes shaft pushing protrusion 256 of second lever 234 to contact shaft 190, pushing it downward and thereby also pushing cams 184 downward to the extent that the magnetic attraction between magnets 202 and the one of the plurality of horizontal wires 130 is broken. At this point, gravity causes shaft 190 to fall to the lowermost position and cams 184 to pivot back to the passive position. Thereafter, the user may gradually release the second lever 234 and, in the absence of cams 184 for support, the weight of rack assembly 124 on rack lifting protrusion 254 of second lever 234 and rack lifting protrusion 246 of first lever 206 causes first lever 206 and second lever 234 to rotate back to their original positions.

Figure 8A:
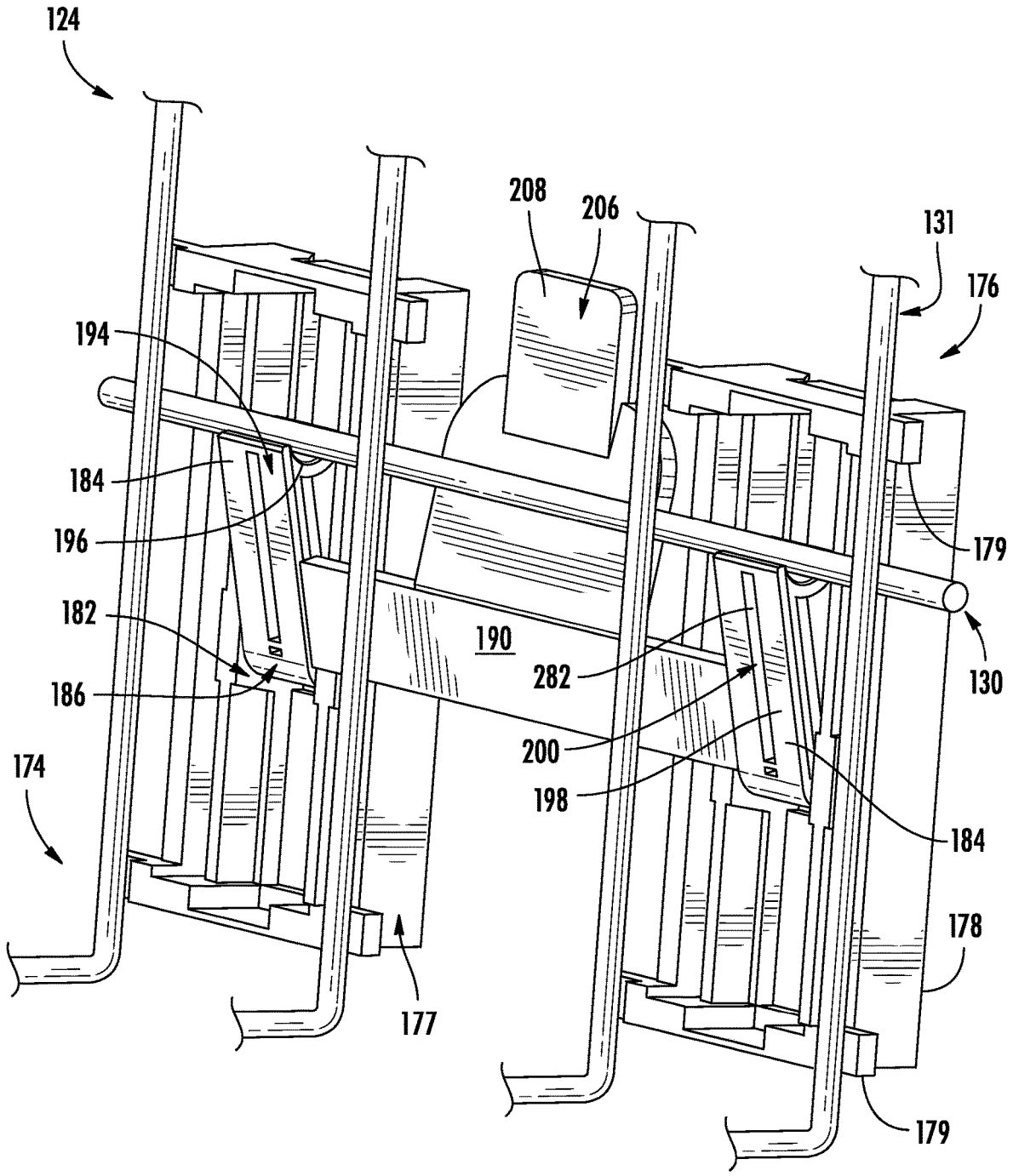
FIG. 8A provides a perspective internal view of a height adjustment assembly with a single fixed lever assembly according to an exemplary embodiment of the present disclosure wherein a rack is in the raised position.
Figure 8B:
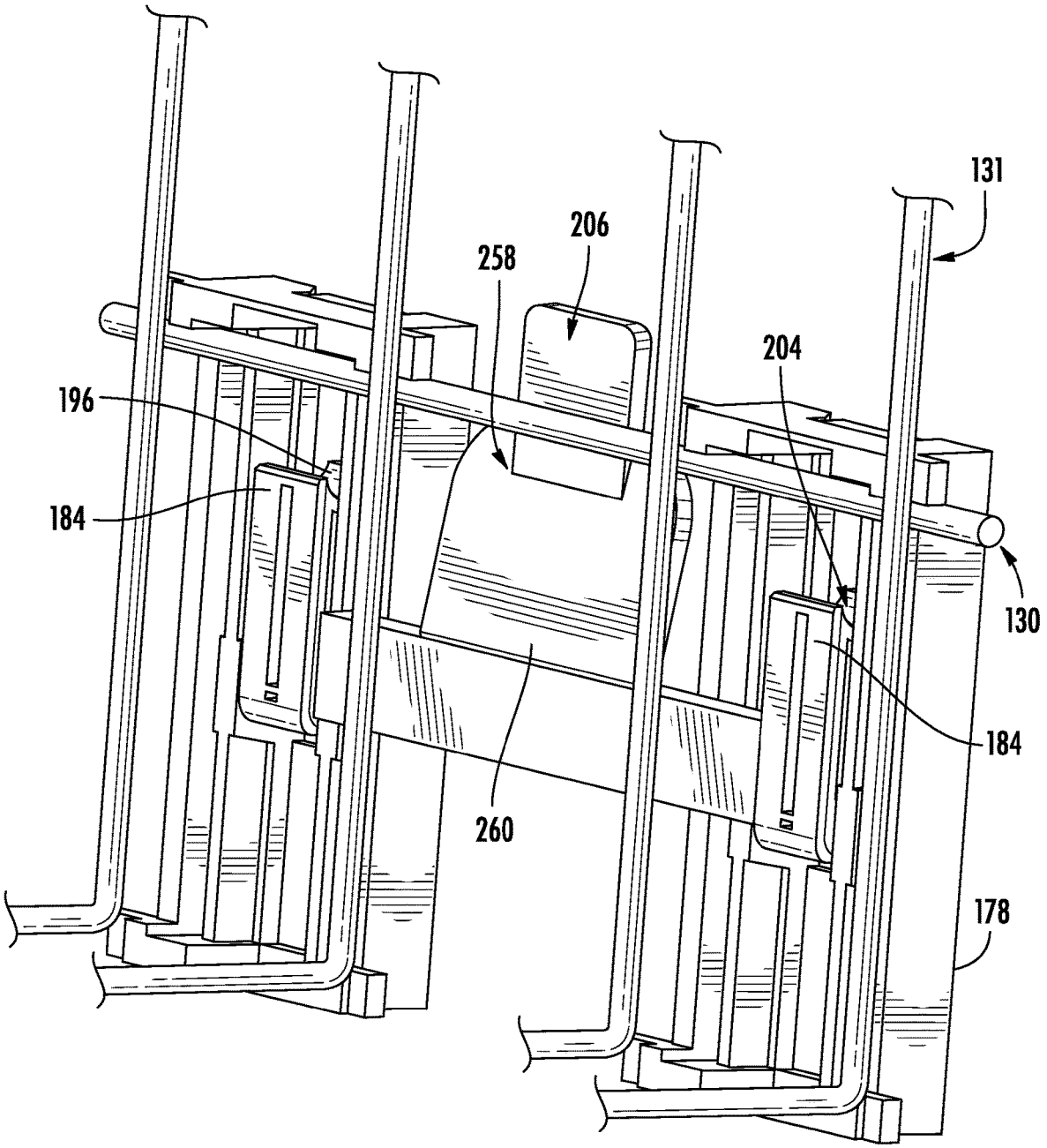
FIG. 8B provides a perspective internal view of a height adjustment assembly with a single fixed lever assembly according to an exemplary embodiment of the present disclosure wherein a rack is in the release position.

Still another alternative embodiment employing the height adjustment assembly 177 and other elements of dishwasher appliance 10 is illustrated is illustrated in FIGS. 8A-8B. In this embodiment dishwasher appliance 10 further includes a first lever 206 pivotable about a transverse axis and having a first end 258 and a second end 260. Second end 260 of first lever 206 may be attached to a shaft 190. Shaft 190 may be fixedly connected to the one or more cams 184. In this embodiment, the one or more cams 184 is at least two cams 184 space apart from one another in the transverse direction. Additionally, first lever 206 may be attached to shaft 190 at a fixed angle such that pivoting first lever 206 also pivot shaft 190 and cams 184.

In this embodiment, cams 184 may be contained within housing 178 and angled away from rack assembly 124 while in the passive position. Rack assembly 124 begins in a lowered position. A user may manually lift rack assembly 124 when it is desirable to raise rack assembly 124. In doing so, the one of the plurality of horizontal wires 130 comes in proximity to magnets 202 of cams 184, pivoting cams 184 toward rack assembly 124 and into the retaining position. The user may then set the one of the plurality of horizontal wires 130 down on retaining surface 196 of cams 184, where rack assembly 124 is then in the raised position. In this embodiment, retaining surfaces 196 of cams 184 may be flat.

When it is desirable to lower rack assembly 124, the user presses first lever 206 in the lateral direction away from rack assembly 124. This rotates first lever 206, shaft 190, and cams 184. Simultaneously, the user may lift rack assembly slightly upward to the release position. The flat retaining surface 196 of cams 184 rotate out from under the one of the plurality of horizontal wires 130, breaking the magnetic attraction and allowing rack assembly 124 to be gently lowered to the lowered position and cams 184 to fall to their passive position. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance comprising:

a metal rack having a first sidewall and a second sidewall spaced apart in the lateral direction and defining a rack interior and a rack exterior, the first sidewall and the second sidewall each including a plurality of horizontal wires and a plurality of vertical wires, the metal rack moveable between a lowered position, a raised position, and a release position;

one or more housings on the rack exterior and in contact with the first sidewall or the second sidewall;

one or more covers on the rack interior and in contact with the first sidewall or the second sidewall of the rack, wherein each of the one or more covers is connected to one of the one or more housings through the first sidewall or the second sidewall, the cover and the housing together defining a housing chamber;

one or more cams within the housing chamber rotatable between a passive position and a retaining position, each cam including a first end, wherein the first end of each cam further includes an opening and a shaft extending through the opening, each cam pivotable about the axis of the shaft;

a second end spaced apart from the first end, wherein the second end of the cam includes a retaining surface;

a cam body extending from the first end to the second end and defining a cam chamber;

a magnet within each cam chamber, the magnet exerting an attraction force on one of the plurality of horizontal wires of the metallic rack within the housing chamber such that moving the metallic rack from the lowered position to the raised position pivots the cam from the passive position to the retaining position and wherein the cam is configured to support the one of the plurality of horizontal wires of the metallic rack when the cam is in the retaining position.

2. The dishwasher appliance of claim 1, wherein the retaining surface of each cam forms a depression for receiving the one of the plurality of horizontal wires of the metallic rack within the depression.

3. The dishwasher appliance of claim 2, wherein the release position of the metal rack is higher than the raised position of the metal rack and lifting of the metal rack from the raised position to the release position breaks the attraction force between the magnet and the one of the plurality of horizontal wires of the metallic rack within the housing chamber such that the one or more cams fall to the passive position.

4. The dishwasher appliance of claim 3, the dishwasher appliance further including a first lever, the first lever including a first handle portion, a connecting portion, and a lifting portion, the first handle portion and the lifting portion connected at a fixed angle at the connecting portion, the first lever moveable between a lower rack position, a raise rack position, a resting raised rack position, and a resting lowered rack position.

5. The dishwasher appliance of claim 4, the lifting portion of the first lever further including a lever rotation protrusion extending from the lifting portion of the first lever laterally in the direction of the metal rack and situated above the one of the plurality of horizontal wires of the metallic rack within the housing chamber;

a rack lifting protrusion extending from the lifting portion of the first lever laterally in the direction of the metal rack and situated below the one of the plurality of horizontal wires of the metallic rack within the housing chamber; and a shaft pushing protrusion extending radially outward from the connecting portion.

6. The dishwasher appliance of claim 5, wherein the one or more housings include a housing sidewall, a housing back wall, and a wall stop extending laterally from the housing sidewall and transversely from the housing back wall, the wall stop defining a lip and the wall stop and housing back wall defining an offset space.

7. The dishwasher appliance of claim 5, the one or more cams further comprising at least two cams spaced apart in the transverse direction and connected by the shaft.

8. The dishwasher appliance of claim 7, the housing further including a volume extending transversely for the entire length of the shaft.

9. The dishwasher appliance of claim 3, the dishwasher appliance further including dual handle assembly, the dual handle assembly including a first lever and a second lever, the first lever including a first handle portion and a first lever body, the second lever including a second handle portion and a second lever body, and the first lever and the second lever being pivotable about a common pivot point.

10. The dishwasher appliance of claim 9, the first lever body further including a lever rotation protrusion extending from the first lever body laterally in the direction of the metal rack and situated above the one of the plurality of horizontal wires of the metallic rack within the housing chamber; and a rack lifting protrusion extending from the first lever body laterally in the direction of the metal rack and situated below the one of the plurality of horizontal wires of the metallic rack within the housing chamber.

11. The dishwasher appliance of claim 10, the second lever body further including a first side and a second side on opposite sides of the pivot point, the second lever body further including a lever rotation protrusion extending from the second lever body laterally in the direction of the metal rack and situated above the one of the plurality of horizontal wires of the metallic rack within the housing chamber;

a rack lifting protrusion extending from the second lever body laterally in the direction of the metal rack and situated below the one of the plurality of horizontal wires of the metallic rack within the housing chamber; and a shaft pushing protrusion extending from the second lever body laterally in the direction of the metal rack and situated such that the pivot point is substantially between the shaft pushing protrusion and the rack lifting protrusion.

12. The dishwasher appliance of claim 11, the one or more cams further comprising at least two cams spaced apart in the transverse direction and connected by the shaft.

13. The dishwasher appliance of claim 12, the housing further including a volume extending transversely for the entire length of the shaft.

14. The dishwasher appliance of claim 3, the one or more cams further comprising at least two cams spaced apart in the transverse direction and connected by the shaft.

15. The dishwasher appliance of claim 14, the dishwasher appliance further including a first lever pivotable about a transverse axis and having a first end and a second end, the second end of the lever attached to the shaft at a fixed angle such that pivoting the first lever also pivots the shaft and the at least two cams.

16. A dishwasher appliance comprising:

a metal rack having a first sidewall and a second sidewall spaced apart in the lateral direction and defining a rack interior and a rack exterior, the first sidewall and the second sidewall each including a plurality of horizontal wires and a plurality of vertical wires, the metal rack moveable between a lowered position and a raised position;

one or more housings on the rack exterior and in contact with the first sidewall or the second sidewall and defining a housing chamber;

one or more cams within the housing chamber rotatable between a passive position and a retaining position, each cam including a first end, wherein the first end of each cam further includes an opening and a shaft extending through the opening, each cam pivotable about the axis of the shaft;

a second end spaced apart from the first end, wherein the second end of the cam includes a retaining surface;

a cam body extending from the first end to the second end and defining a cam chamber;

a magnet within each cam chamber, the magnet exerting an attraction force on one of the plurality of horizontal wires of the metallic rack within the housing chamber such that moving the metallic rack from the lowered position to the raised position pivots the cam from the passive position to the retaining position and wherein the cam is configured to support the one of the plurality of horizontal wires of the metallic rack when the cam is in the retaining position.

17. The dishwasher appliance of claim 16, wherein the retaining surface of each cam is a flat surface.

18. The dishwasher appliance of claim 17, the dishwasher appliance further including a first lever pivotable about a transverse axis and having a first end and a second end, the second end of the lever attached to the shaft at a fixed angle such that pivoting the first lever also pivots the shaft and the one or more cams and breaks the attraction force between the magnet and the one of the plurality of horizontal wires of the metallic rack within the housing chamber such that the one or more cams fall to the passive position.

19. The dishwasher appliance of claim 16, the dishwasher appliance further including a first lever, the first lever including a first handle portion, a connecting portion, and a lifting portion, the first handle portion and the lifting portion connected at a fixed angle at the connecting portion, the first lever moveable between a lower rack position, a raise rack position, a resting raised rack position, and a resting lowered rack position.

20. The dishwasher appliance of claim 19, the lifting portion of the first lever further including a lever rotation protrusion extending from the lifting portion of the first lever laterally in the direction of the metal rack and situated above the one of the plurality of horizontal wires of the metallic rack within the housing;

a rack lifting protrusion extending from the lifting portion of the first lever laterally in the direction of the metal rack and situated below the one of the plurality of horizontal wires of the metallic rack within the housing; and a shaft pushing protrusion extending radially outward from the connecting portion.

* * * * *